US005127194A

United States Patent [19]

Jobin

[11] Patent Number: 5,127,194

[45] Date of Patent: Jul. 7, 1992

[54] APPARATUS FOR SHARPENING THE BLADE OF A SKATE

[76] Inventor: Jeane-Pierre Jobin, 6259 Louis-Hémon, Montreal (Quebec), Canada, H2G 2K8

[21] Appl. No.: 566,534

[22] Filed: Aug. 10, 1990

[51] Int. Cl.[5] ..... B24B 7/00

[52] U.S. Cl. ..... 51/5 D; 51/74 BS; 51/91 BS; 51/92 BS; 51/965.76; 51/325

[58] Field of Search ..... 51/5 D, 74 R, 74 BS, 51/91 R, 91 BS, 92 R, 92 BS, 165.74, 165.76, 165.87, 325

[56] References Cited

FOREIGN PATENT DOCUMENTS

| | | |
|---|---|---|
| 874727 | 1/1971 | Canada . |
| 914420 | 3/1972 | Canada . |
| 892317 | 4/1972 | Canada . |
| 944156 | 7/1974 | Canada . |
| 941165 | 10/1974 | Canada . |
| 964067 | 11/1975 | Canada . |
| 984611 | 1/1976 | Canada . |
| 987109 | 7/1976 | Canada . |
| 1013945 | 6/1977 | Canada . |
| 1033171 | 11/1978 | Canada . |
| 1050275 | 3/1979 | Canada . |
| 1058880 | 3/1979 | Canada . |
| 1060659 | 3/1979 | Canada . |
| 1113724 | 3/1981 | Canada . |
| 1097922 | 10/1981 | Canada . |
| 1118513 | 7/1982 | Canada . |
| 1115529 | 11/1982 | Canada . |
| 1141961 | 4/1983 | Canada . |
| 1210935 | 4/1986 | Canada . |
| 1208023 | 10/1986 | Canada . |

*Primary Examiner*—M. Rachuba
*Attorney, Agent, or Firm*—Darby & Darby

[57] ABSTRACT

The present invention is directed to an apparatus for sharpening the blade of a skate which provides more precision that prior art sharpeners. The apparatus comprises a circular grindstone which can pivot from a work position to a rest or sharpening position. When in the rest position, the grindstone may be sharpened by a diamond, which diamond moves in circular motion when sharpening. The radius of curvature of the circular motion is selectable. The degree of concavity imparted to the blade is defined by curvature of the sharpening diamond. The blade is clamped in a slidable carriage while the grindstone, which is stationary with respect to the sliding motion of the carriage, follows the contour of the blade according to selected template. The blade clamp comprises two movable surfaces which properly center the blade with respect to the grindstone regardless of the blade's thickness.

18 Claims, 17 Drawing Sheets

APPARATUS FOR SHARPENING THE BLADE OF A SKATE

FIELD OF THE INVENTION

The present invention is concerned with an apparatus for sharpening the blade of an ice skate.

BACKGROUND OF THE INVENTION

Numerous types of ice skate sharpening machines have been proposed, and fall into two categories which are floor mounted hand operated machines and floor mounted automatic coin operated machines. The hand operated machines are generally heavy and require much craftmanship to operate, also, in most cases, questionable results are obtained mainly due to the mechanism of the machine itself and the ability of the operator. The floor mounted automatic coin operated machines are heavy, complex and expensive. These automatic machines provide poor sharpening results, this is due to the mechanism of the machine itself.

The blades of hockey ice skates require different radius of concavity depending on the weight of the hockey player. This radius of concavity can be obtained only if precision is built into the machine.

In known ice skate sharpening machines, the object is to have the grindstone to be as much as possible in line with the skate blade so that the radius of convexity of the grindstone forms the intended radius of concavity along the skate blade. These machines do not provide against the effect of the position of the grindstone dressing mechanism with respect to the skate blade central axis, and also they do not provide against the effect of the means for clamping the blade with respect to the thickness of the blade. Hockey skates, figure skates, goalkeeper skates and racing skates have all different thicknesses. Many attempts have been made to have blade clamping means that would hold the central axis of the blade directly in line with the grindstone central axis but poor results have been obtained because proposed blade clamping means always include a fixed side against which a moving side is squeezed. It can easily be seen that for different blade thicknesses, the central axis of the blade is thrown off.

Even worst, since the sharpening diamond is not in line and cannot be in line with the skate blade clamping means then the end result is a blade which has a high edge and a low edge. These above described statements are true for both the hand operated and automatic coin operated machines.

Hand operated machines alter the blade radius of curvature of new skates because of the uneven pressure applied by the grindstone when the blade is applied against it by the operator. This operation produces a light depression in the middle of the blade.

For the sharpening of figure skates, there is one important criteria to respect, the sharpening of the blade end must be square and sharp which means that the grindstone must not terminate its motion at the rear portion of the blade according to a curve. Hand operated machines do not meet this condition although some operators use a mechanical template to meet this square and sharp end condition but the set up is so lengthy that once it is set, it is used exclusively for figure skates. Automatic coin operated machines do not meet the square and sharp end condition, the end of the blade is rounded by the grindstone as it is for the hockey skates.

It must be noted that the problem of centering a figure skating blade directly in line with the grindstone is the same as it is for a hockey skate. The same applies for the radius of concavity where the hand operated sharpening machines have a range of selection with a poor accuracy whereas automatic coin operated machines have only one radius of concavity which is generally 0.75 radius.

It is difficult to accurately and efficiently sharpening the grindstone for both manual and automatic operated machines. For manual operated machines, the sharpening of the grindstone according to a selected radius of concavity is tideous because the sharpening diamond is integrated on a shaft with a cone end which generally slides in a hole. Thus, by pulling it out or in, a maximum or a minimum radius of concavity is obtained. However, when the sharpening of the grindstone is actually performed, the manual mechanical advance of the diamond is usually not done with great precision so that, instead of having only the diamond point touching the sharpening surface of the grindstone, a part of the cone touches the sharpening surface at the beginning of a sharpening cycle before that the diamond point touches the grindstone.

Also, it happens frequently that the operator drives the diamond too much into the sharpening surface of the grindstone so that grinding particles are emitted in every directions, this result produces a health hazard for the lungs of the operator.

Automatic coin operated machines have different problems since only one radius of convexity is given and this is generally 0.75 radius. The sharpening of the grindstone is controlled mechanically and electronically. The mechanical assembly is generally a yoke with a diamond in the center, the diamond describing an arc on the sharpening surface of the grindstone. When the grindstone is worn to a point where the diamond does not touch the grindstone, the machine is automatically stopped, a light indicates to the operator that it is time to adjust the diamond position. As far as dust particles are concerned, most automatic machines have a vacuum to collect grinding particles.

Both manual and automatic machines accept hockey and figure skates but they are not designed for goalkeeper skates, long blade skates and racing skates.

The general public is more demanding when their skates are sharpened, especially when expensive skates are concerned, they do not want too much material being ground off their blade. Also, a preselected radius of concavity is required.

The hockey player would like to have a very personalized skate sharpening with a radius of concavity selected with respect to his weight. The figure skater would like to have his skate sharpened with a selected radius of concavity, and with a sharp and square end. The hockey goalkeeper would like to have his skate with a radius of concavity of at least ¾ of an inch. The race skater has to sharpen his skate himself because existing sharpening machines cannot perform the job.

Hand operated machines can generally provide a variety of radius of concavity but the limitations are that the radius of concavity is not aligned with the central longitudinal axis of the blade because the sharpening diamond is not aligned with respect to the skate blade clamping mechanism which is itself limited by its design of having a fixed side onto which a moving side is squeezed. This design does not allow a variation of the blade thickness. In the case of figure skate, the chrome deposit is uneven and the thickness of this kind of skate can vary substantially from one end of the blade to the other. Therefore, the end result of having good sharpened skates depends entirely on the ability and craftmanship of the operator.

For a figure skate, the blade is sharpened in a similar manner as it is for a hockey skate, as a result, the end portion of the figure skate is rounded and not sharp and square as it is supposed to be. The reason for this resides in the fact that the special set up required to obtain the square and sharp end, is difficult to install.

Goalkeepers whether they like it or not, do have a radius of concavity on their blade which is generally large in order to minimize the radius effect and this is because the grindstone cannot be sharpened in a flat manner due to the mechanism of the machine itself. Automatic coin operated machines have only one radius of concavity which is generally 0.75 radius, and the diamond is not aligned with the blade clamping mechanism which produces high and low edges on the sharpened blade.

An object of the present invention is to provide an apparatus for sharpening the blade of a skate with more precision than the one obtained with the apparatus known in the art.

SUMMARY OF THE INVENTION

According to the present invention, there is provided an apparatus for sharpening a blade of a skate, comprising:

a frame;

a circular grindstone having a working position in which said grindstone can contact said blade, and a rest position in which said grindstone can be sharpened;

an arm for supporting said grindstone, said arm having a first extremity provided with an axle for supporting said grindstone, and a second opposed extremity, said arm being capable of pivoting around an axle firmly attached to said frame so that said grindstone can be pivoted from said working position to said rest position and vice versa:

a diamond assembly including:

a diamond for sharpening said grindstone when said grindstone is in said rest position by pivoting said diamond horizontally from a central position to alternatively left or right with respect to a pivoting axis so that said diamond defines a circular motion which has a radius of curvature determined by a distance between said diamond and said pivoting axis; and a member having a first extremity onto which said diamond is fixed, and a second extremity provided with a surface facing the ground;

a body for supporting said diamond assembly by said second extremity of said member, including:

a screw separated along its length to form first and second complementary elongated parts;

a pivoting pin transverse to a longitudinal axis of said screw, said pivoting pin connecting said first part to said second part so that said second part can be pivoted with respect to said first part, around said pivoting pin, said body comprising upper and lower members forming a cavity provided with threads contacting upper and lower portions of said screw so that said screw can be screwed along said cavity by rotation thereof, said body including a bearing surface for vertically supporting said surface of said second extremity of said member, when said second part of said screw is in a lower position, said second part can be pivoted with said lower member of said body, horizontally from a central position to alternatively left or right around said pivoting pin;

supporting means for supporting said body with respect to said frame of said apparatus; and connecting means for rendering said second extremity of said member of said diamond assembly solid with an extremity of said second complementary elongated part only when said second part is pivoted horizontally away from its central position so that said pivoting pin forms said pivoting axis of said diamond, whereby said radius of curvature can be modified by displacing said screw along said cavity so that said pivoting axis of said diamond is displaced with respect to said diamond.

According to the present invention, there is also provided an apparatus for sharpening a blade of a skate, comprising:

a frame;

a circular grindstone having a working position in which said grindstone can contact said blade, and a rest position in which said grindstone can be sharpened;

an arm for supporting said grindstone, said arm having a first extremity provided with an axle for supporting said grindstone, and a second opposed extremity, said arm being capable of pivoting around an axle firmly attached to said frame so that said grindstone can be pivoted from said working position to said rest position and vice versa;

a diamond assembly including:

a diamond for sharpening said grindstone when said grindstone is in said rest position by pivoting said diamond horizontally from a central position alternatively to left or right with respect to a pivoting axis so that said diamond defines a circular motion which has a radius of curvature determined by a distance between said diamond and said pivoting axis; and a member having a first extremity onto which said diamond is fixed, and a second extremity;

a body for supporting said diamond assembly by said second extremity of said member, including:

an elongated element; and a pivoting pin transverse to a longitudinal axis of said elongated element so that said elongated element can be pivoted around said pivoting pin;

supporting means for supporting said body with respect to said frame;

connecting means for rendering said second extremity of said member solid with an extremity of said elongated element so that said pivoting pin forms said pivoting axis of said diamond;

first motor means for moving said body with respect to said frame so that when a sharpening of said grindstone is needed, said body is moved with respect to said frame to bring said diamond closer to said grindstone by a predetermined distance; and linking means for rendering said body solid with said second opposed extremity of said arm so that when said diamond is brought closer to said grindstone, said arm for supporting said grindstone is pivoted according to a predetermined angle by means of said linking means, whereby a wear of said grindstone is compensated by a feedback action provided by said linking means so that said diamond always contacts said grindstone at a preferred level during a sharpening of said grindstone.

According to the present invention, there is also provided an apparatus for sharpening a blade of a skate, comprising:

a frame;

a circular grindstone having a working position in which said grindstone can contact said blade, and a rest position in which said grindstone can be sharpened;

an arm for supporting said grindstone, having a first extremity provided with an axle for supporting said grindstone, and capable of pivoting around an axle firmly attached to said frame so that said grindstone can be pivoted from said working position to said rest position;

a diamond assembly including:

a diamond for sharpening said grindstone when said grindstone is in said rest position by pivoting said diamond horizontally from a central position alternatively to left or right with respect to a pivoting axis so that said diamond defines a circular motion which has a radius of curvature determined by a distance between said diamond and said pivoting axis; and a member having a first extremity onto which said diamond is fixed, and a second extremity provided with a surface facing the ground;

a body for supporting said diamond assembly by said second extremity;

supporting means for supporting said body with respect to said frame;

conveying means for holding said blade, and for conveying an upper edge of said blade against said grindstone when said grindstone is in said working position, said conveying means comprising:

a carriage assembly having:

a frame provided with a longitudinal axis;

two fixed portions solid with said frame of said carriage assembly and disposed on both sides of said longitudinal axis, said fixed portions being provided respectively with oblique surfaces facing each other and converging in a same direction;

two mobile portions disposed on both sides of said longitudinal axis of said carriage assembly, said mobile portions being provided respectively with oblique surfaces facing and contacting said oblique surfaces of the respective fixed portions, and with gripping surfaces facing each other with respect to said longitudinal axis of said carriage assembly; and resilient means for biasing said oblique surfaces of said mobile portions against the respective oblique surfaces of said fixed portions;

moving means for moving said mobile portions in a direction parallel to said longitudinal axis of said carriage assembly, against said fixed portions so that said blade can be held by said gripping surfaces, whereby said upper edge of said blade has its central longitudinal axis forming with said longitudinal axis of said carriage assembly always a same predetermined plane independently of a thickness of said blade.

DETAILED DESCRIPTION OF THE DRAWINGS

Figure 1:
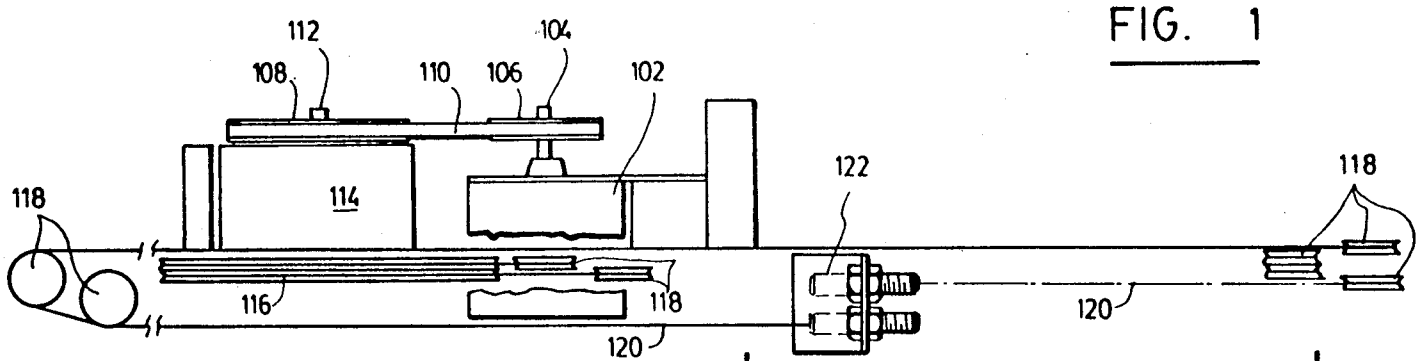
FIG. 1 is a partial view from above of a portion of a system for conveying the blade of a skate according to the present invention.

It should be noted that every element of the present invention is identified by the same number in all the drawings. Referring now to FIGS. 1, 2, 3, 4, 5, 14 ,15 and 16, there is shown conveying means of an apparatus for sharpening a blade 46 of a skate 48 by which means the blade 46 is held so that its upper edge can be conveyed against a grindstone 2 when it is in its working position.

The conveying means comprise a carriage assembly 50 having a frame provided with a longitudinal axis C—C; two fixed portions 52 solid with the frame 50 and disposed on both sides of the longitudinal axis C—C, the fixed portions 52 being provided respectively with oblique surfaces 54 facing each other and converging in a same direction; and two mobile portions 56 disposed on both sides of the longitudinal axis C—C. The mobile portions 56 are provided respectively with oblique surfaces 58 facing and contacting the oblique surfaces 54 of the respective fixed portions 52, and with gripping surfaces 60 facing each other with respect to the longitudinal axis C—C. There are provided first and second pairs of springs 62, 63 for biasing the oblique surfaces 58 of the mobile portions 56 against the respective oblique surfaces 54 of the fixed portions 52. The conveying means also comprise moving means for moving the mobile portions 56 in a direction parallel to the longitudinal axis C—C against the fixed portions 52 so that the blade 46 can be held by the gripping surfaces 60, whereby the upper edge of the blade 46 has its central longitudinal axis forming with the longitudinal axis C—C always a same predetermined plane independently of the thickness of the blade.

This moving means comprise a threaded element 70 having an elongated body provided with a threaded portion 72 along its length. The threaded element 70 has a first extremity 74 adjacent to the frame of the carriage assembly, and a second extremity provided with a handle 78. This handle 78 comprises a ratchet to limit the torque performed by the operator. The moving means also comprise a horizontal member 80 provided with a threaded cavity in which the threaded portion 72 of the threaded element 70 is engaged, the horizontal member 80 having two extremities. The moving means also comprise a pair of vertical members 82, 84 having respectively first and second extremities which are respectively connected by means of a horizontal pivoting axis 86 to the corresponding two extremities of the horizontal member 80; and a pair of horizontal members 88, 90 having respectively first and second extremities. The first extremities of said pair of horizontal members 88, 90 are respectively connected by means of vertical and horizontal pivoting axes 92, 94 to the corresponding extremities of the pair of vertical members 84, 82.

The second extremities of the pair of horizontal members 88, 90 are respectively connected to the mobile portions 56 by means of a vertical pivoting axis 96. Consequently, the mobile portions 56 can be moved in a direction parallel to the longitudinal axis C—C against the fixed portions 52 by a rotation of the handle 78. The first pair of springs 62 are respectively connected between the frame of the carriage assembly 50 and the second extremities of the pair of horizontal members 88, 90 for biasing the oblique surfaces 58 of the mobile portions 56 against the respective oblique surfaces 54 of the fixed portions 52. The second pair of springs 63 is respectively connected between the fixed and mobile portions 52, 56.

The carriage assembly 50 is also provided with a vertical pivoting axis 100, connecting the frame of the carriage assembly 50 to one of the fixed portions 52 so that the gripping surfaces 60 of its adjacent mobile portion 56 can pivot, whereby an adjustment of the gripping surfaces 60 with respect to the blade 46 can be provided when the blade is curved along its length.

Referring now more specifically to FIG. 1, there is shown schematically from above the system for actually moving the carriage assembly. This system comprises a motor 102 having a shaft 104 connected to a pulley 106 which is connected to another pulley 108 by means of a strap 110. This pulley 108 is solid with a shaft 112 of a gearing down assembly 114. The output shaft of this gearing down assembly 114 is solid with a pulley 116 which is connected to several pulleys 118 by means of two cables 120. Each of these cables 120 has one of its extremities connected to a bracket 122 which is solid with the carriage (not shown in FIG. 1), whereby the operator can move the carriage assembly along its longitudinal axis C—C by activating the motor 102.

Figure 2:
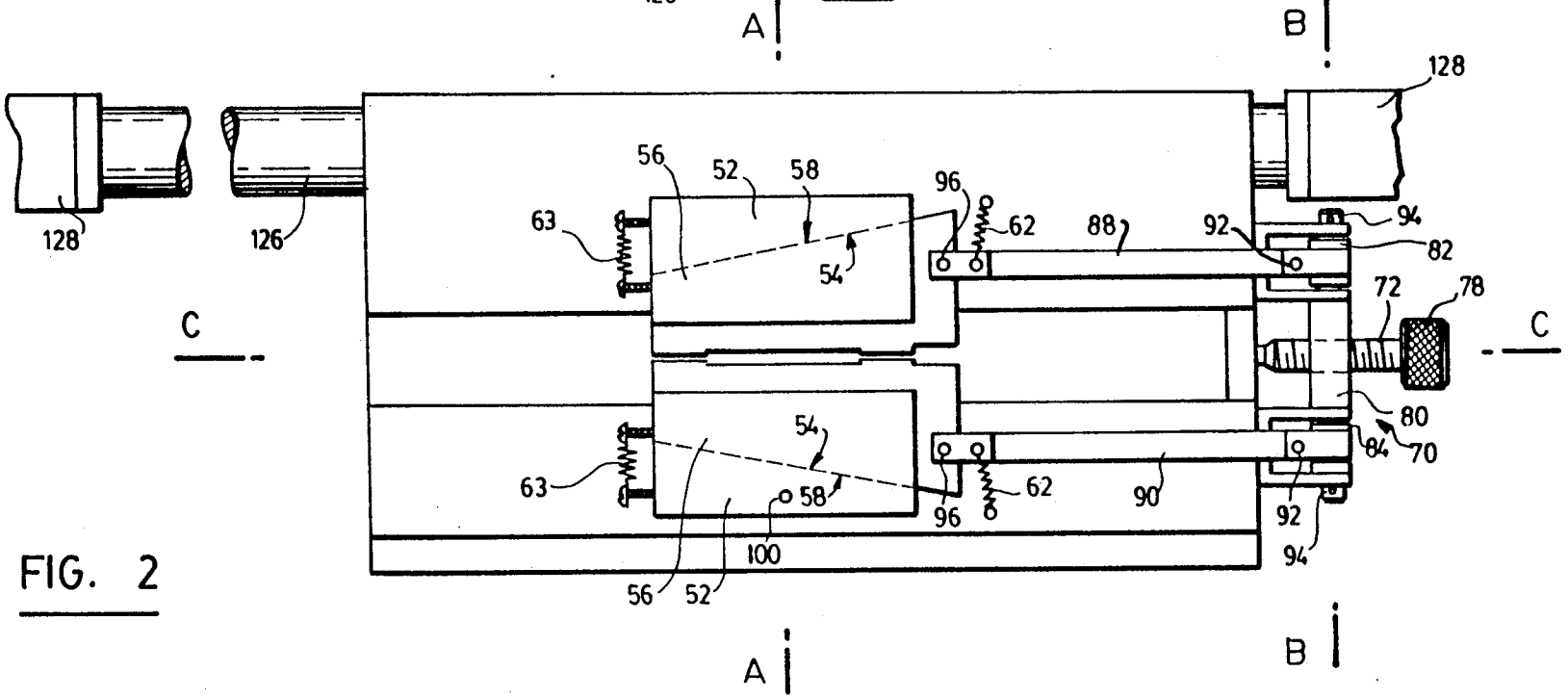
FIG. 2 is a partial view of another portion of the system for conveying the blade of a skate.

Referring now to FIG. 2, the carriage assembly 50 has one of its lateral portions provided with a longitudinal cylindrical cavity into which a sliding tube 126 is engaged. This sliding tube 126 is supported by its two extremities by tube supports 128 which are solid with the frame of the apparatus. The other lateral portion 129 of the carriage assembly 50 is provided with a surface facing the ground that rests over a bearing surface (not shown in FIG. 2) solid with the frame of the apparatus, and onto which it can slide. When the carriage assembly 50 is moved along its longitudinal axis C—C, it is supported on one of its sides by the sliding tube 126 and on its other side 129 by the bearing surface solid with the frame of the apparatus.

Referring now more specifically to FIGS. 3, 4, 5 and 12, there is shown, among other elements, a system needed for figure skates. This system provides means for positioning the blade 46 of a figure skate with respect to the carriage assembly 50. This system for positioning comprises a frame 130 forming a longitudinal slot at its lower edge in which sliding elements 132 can slide. These sliding elements 132 are solid with each other with respect to the axis D—D by means of a strap system comprising a strap 134 and several pulleys 136 supported by the frame 130. The system for positioning also comprises a motor 138 having its shaft 139 (shown on FIG. 12) connected to a cam 140 shown on FIG. 12 which is connected to one extremity of a longitudinal member 142 by means of a pivoting pin 141. The other extremity of this longitudinal member 142 is connected to linking arms 144, 146 by means of a horizontal pivoting axis 148. The upper extremity of the linking arm 144 is connected to the frame of the apparatus by means of a horizontal pivoting axis 150. The lower extremity of the linking arm 146 is connected to an end of the frame 130 by means of a horizontal pivoting axis 152.

Figure 14:
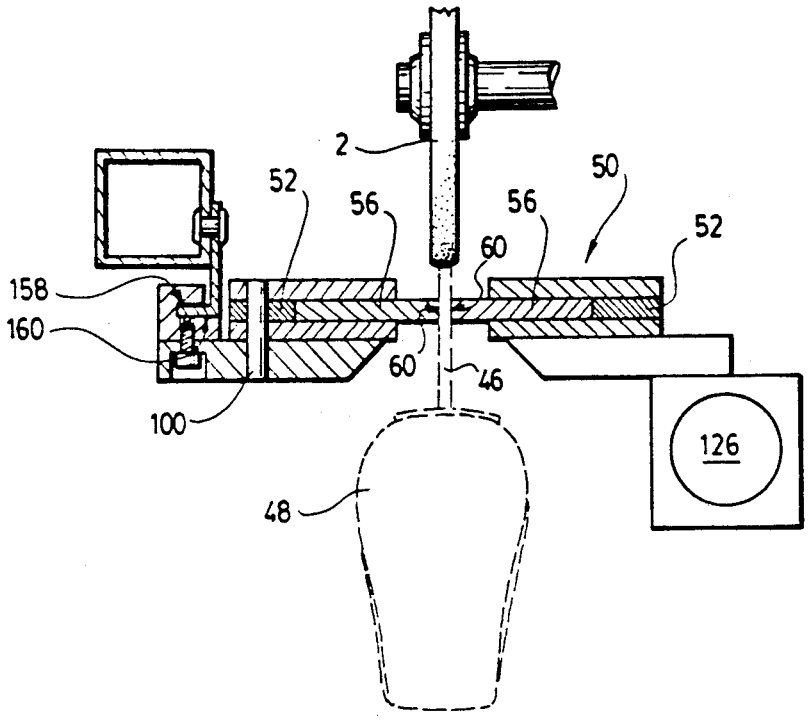
FIG. 14 is a cross-section view of the system shown in FIG. 2 along line A—A, with additional details, with respect to the blade and the grindstone.
Figure 15:
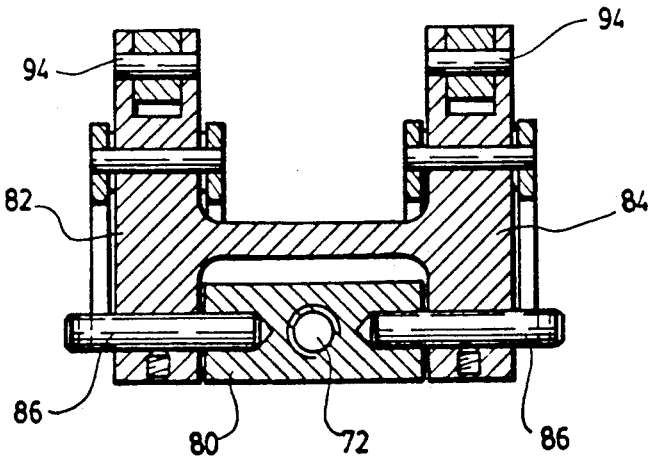
FIG. 15 is a partial cross-section view of the system shown in FIG. 2 along line B—B.
Figure 16:
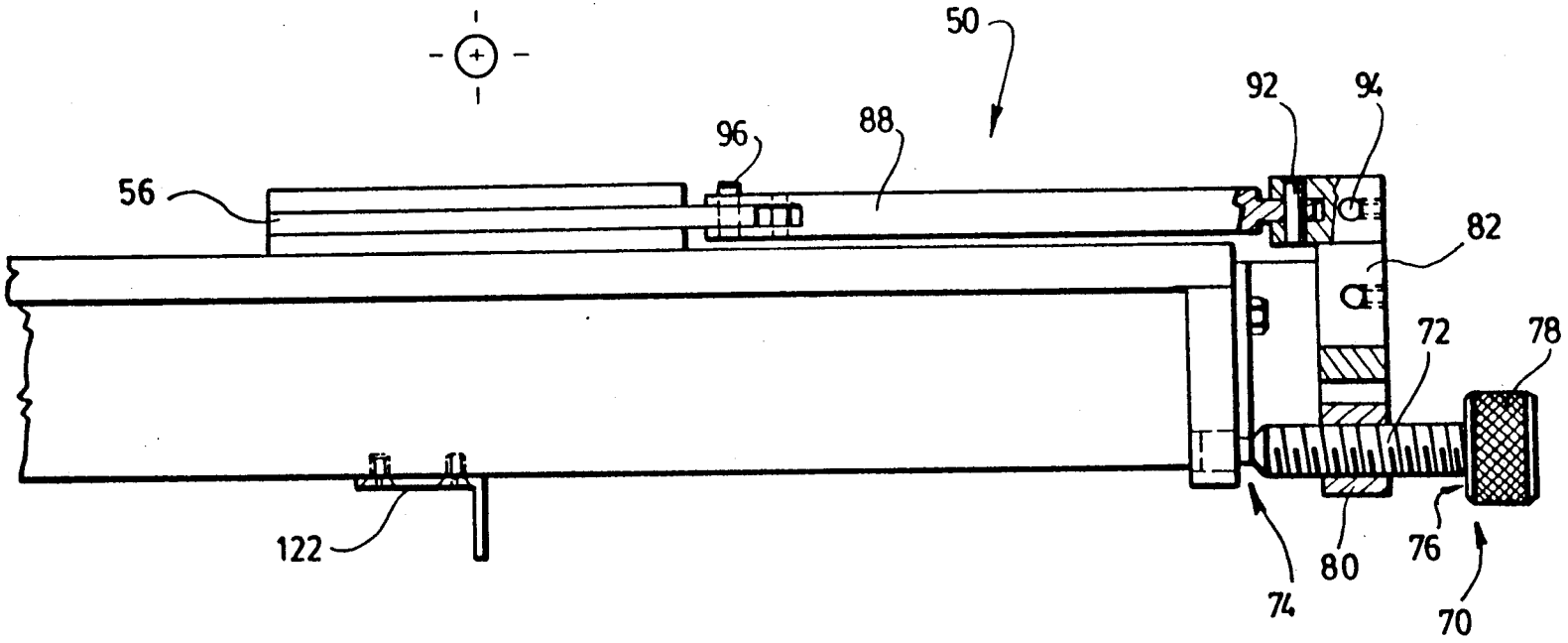
FIG. 16 is a partial cross-section view of the system shown in FIG. 2 along line C—C.

Referring now to FIG. 14, there is shown with more details by which means the carriage assembly 50 is supported. On one of its lateral portions it is supported by the sliding tube 126, and on its other lateral portions it is supported by a bearing surface 160 along which the surface 158 can slide. This bearing surface 160 is solid with the frame of the apparatus. When the carriage assembly 50 is moved by the motor 102, the surface 158 is sliding over the bearing surface 160.

Figure 17:
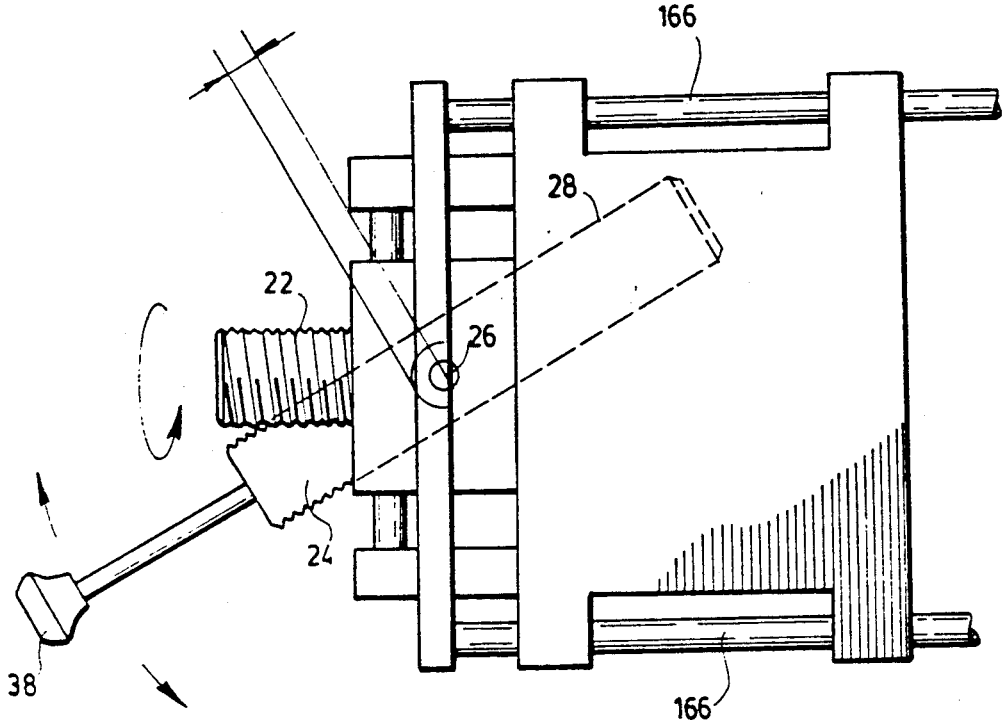
FIGS. 17 and 18 (are schematic views illustrating respectively from above, in two different positions, a portion of the system shown in FIG. 7.
Figure 18:
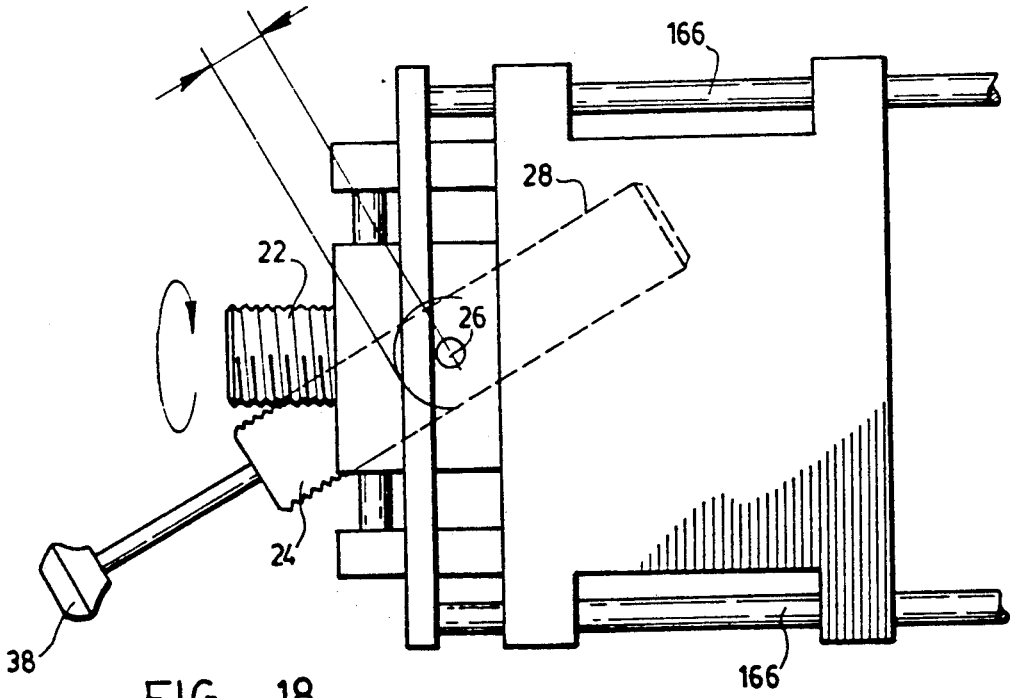
Figure 19:
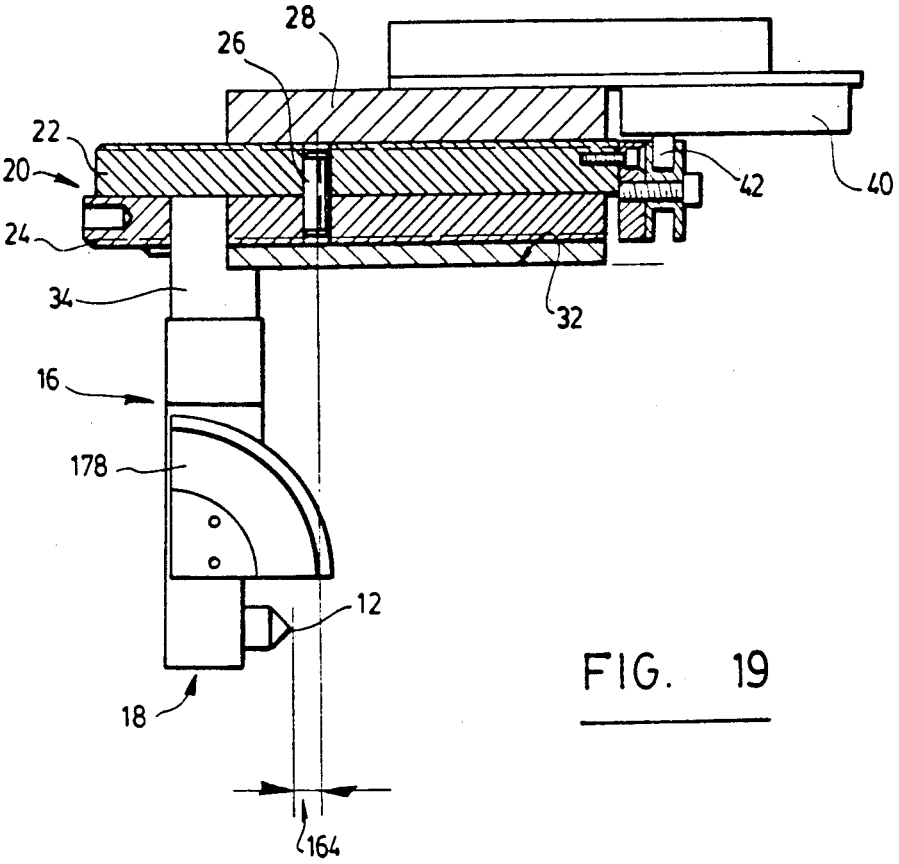
FIGS. 19 and 20 are schematic side views illustrating respectively the apparatus shown in FIGS. 17 and 18.
Figure 20:
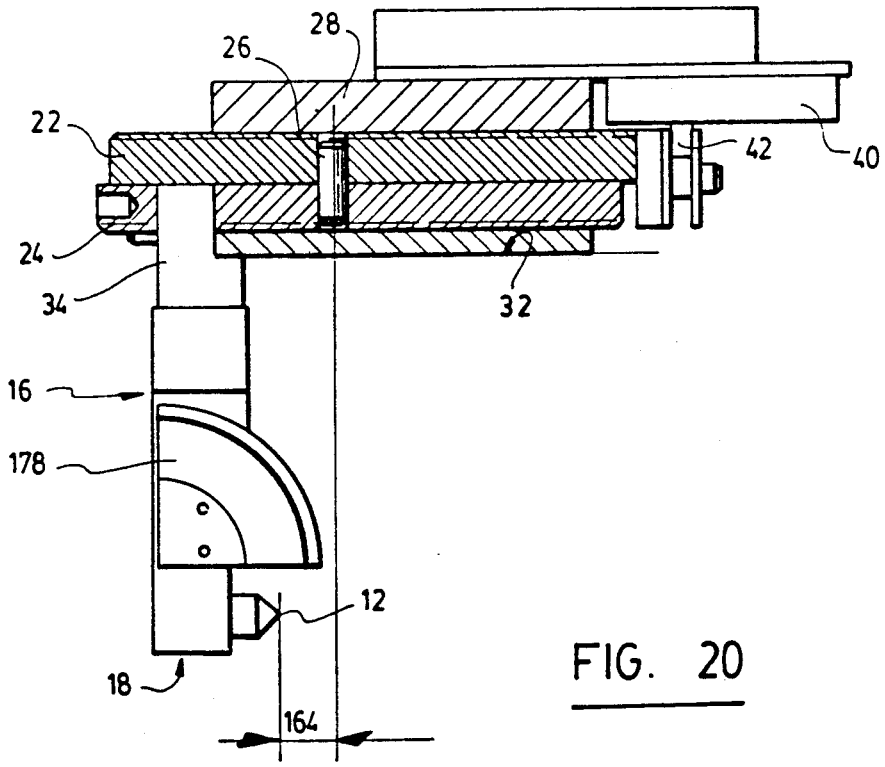

Referring now to FIGS. 6, 7, 13, 17, 18, 19 and 20, there is shown the diamond assembly with respect to the grindstone and the necessary means for operating the diamond assembly. The apparatus comprises the circular grindstone 2 having a working position in which it can contact the blade and a rest position (shown in FIG. 6) in which it can be sharpened. An arm 4 is provided for supporting the grindstone 2. The arm 4 has a first extremity 6 provided with an axle 8 for supporting the grindstone 2, and a second opposed extremity. The arm 4 is capable of pivoting around an axle 10 firmly attached to the frame of the apparatus by which the grindstone can be pivoted from its working position to its rest position and vice versa. The diamond assembly includes a diamond 12 for sharpening the grindstone 2 when it is in its rest position by pivoting the diamond 12 horizontally from a central position to alternatively left or right with respect to a pivoting axis 26 as shown in FIGS. 17 and 18. The diamond assembly defines a circular motion which has a radius of curvature determined by a distance 164 shown on FIGS. 17 to 20 between the diamond 12 and the pivoting axis 26. A member 16 is provided for supporting the diamond 12. This member 16 has a first extremity 18 onto which the diamond 12 is fixed, and a second extremity provided with a surface 32 facing the ground. The apparatus also comprises a supporting body for supporting the diamond assembly by the second extremity of the member 16.

The supporting body comprises a screw 20 separated along its length to form first and second complementary elongated parts 22, 24; and a pivoting pin 26 transverse to the longitudinal axis of the screw 20. The pivoting pin 26 connects the first part 22 to the second part 24 so that the second part 24 can be pivoted with respect to the first part 22. The supporting body comprises upper and lower members 28 and 31 forming a cavity provided with threads contacting respectively upper and lower portions of the screw 20 so that it can be screwed along the cavity by rotation thereof.

The supporting body includes a supporting surface 30 for vertically supporting the surface 32 of the member 31 which is solid with the second extremity of the member 16. When the second part 24 of the screw 20 is in a lower position, it can be pivoted with the member 31 horizontally from its central position to alternatively left or right around the pivoting pin 26 as shown in FIGS. 17 and 18.

The supporting body has a member 29 solid with the member 28 and laterally supported by two rods 166 that are solid with the frame of the apparatus. The member 29 can slide horizontally along these two rods 166. Connecting means are provided for rendering the second extremity of the member 16 solid with an extremity of the second part 24 only when the second part 24 is pivoted horizontally away from its central position so that the pivoting pin 26 forms the pivoting axis of the diamond 12 as shown on FIGS. 17, 18, 19 and 20. These connecting means comprise a portion integral with the second extremity of the member 16, and an upper extremity forming a fork 34 having two prongs surrounding the second part 24 of the screw 20 when it is in its lower position. The prongs have upper extremities which are lower than the lowest portion of the first part 22 of the screw 20 when the second part 24 is in its lower position so that the upper extremities of the prongs do not interfere with the first part 22 when the second part 24 is pivoted alternatively to left or right as it can be seen on FIGS. 19 and 20.

The radius of curvature 164 of the circular motion of the diamond can be modified by displacing the screw 20 along the cavity formed by the members 28 and 31 so that the pivoting axis 26 of the diamond is displaced with respect to the diamond itself, and consequently the radius of curvature 164 is modified as it can be seen on FIGS. 17, 18, 19 and 20.

A handle 38 is attached to the second part 24 of the screw 20 so that an operator can pivot the second part alternatively to left or right. This handle 38 can also be used for rotating the screw 20 along the cavity formed by the members 28 and 31.

A potentiometer 40 is solid with the member 28, it has a sensing element 42 connected to the first part 22 of the screw 20 so that a signal indicative of the radius of curvature can be generated by this potentiometer 40.

The apparatus also comprises a motor 44 moving the supporting body with respect to the frame of the apparatus so that when a sharpening of the grindstone 2 is needed, the supporting body is moved with respect to the frame of the apparatus to bring the diamond 12 closer to the grindstone 2 by a predetermined distance which is preferably 0.05mm. A linking means is provided for rendering the supporting body solid with the second opposed extremity of the arm 4 so that when the diamond 12 is brought closer to the grindstone 2, the arm 4 for supporting the grindstone is pivoted according to a predetermined angle by means of this linking means. Then, a wear of the grindstone 2 is compensated by a feedback action provided by this linking means so that the diamond 12 always contacts the grindstone 2 at a preferred level during a sharpening of the grindstone 2.

The motor 44 comprises a frame 64 rigidly fixed to the supporting body, and a shaft 66 having a first threaded portion 68 engaged in a cylindrical threaded cavity of a body 240 rigidly fixed to the frame of the apparatus so that a rotation of the shaft 66 moves the supporting body with respect to the frame of the apparatus. The shaft 66 has also a second threaded portion 242. The linking means comprise a second motor 244 having frame 76 provided with a cylindrical threaded cavity in which the second threaded portion 242 is engaged, and a shaft 246. A cam 248 is solid with the shaft 246 of the motor 244.

This linking means also comprise an elongated arm 250 having a first extremity 252 provided with a contact surface capable of contacting the peripheral surface of the cam 248, and a second extremity 254 solid with the second opposed extremity of the arm 4 for supporting the grindstone 2, whereby the feedback action is provided by a rotation of the second threaded portion 242 which moves the frame 76 of the motor 244, which displaces the cam 248 which displaces the elongated arm 250 of the linking means to pivot the arm 4 according to the predetermined angle.

The height of the grindstone 2 can be adjusted at different positions depending on the kind of blade that is being sharpened by means of an action of the second motor 244 which rotates the cam 248. The contact surface of the extremity 252 of the arm 250 is provided with a contact switch 256 which produces a signal that indicates whether or not the grindstone 2 is actually sharpening the blade 46, because when the blade is being sharpened, the grindstone 2 is lifted by the blade 46 and consequently the contact switch 256 is pivoted away from the cam 248; and when the blade is not being sharpened, the contact switch 256 contacts the cam 248.

Figure 6:
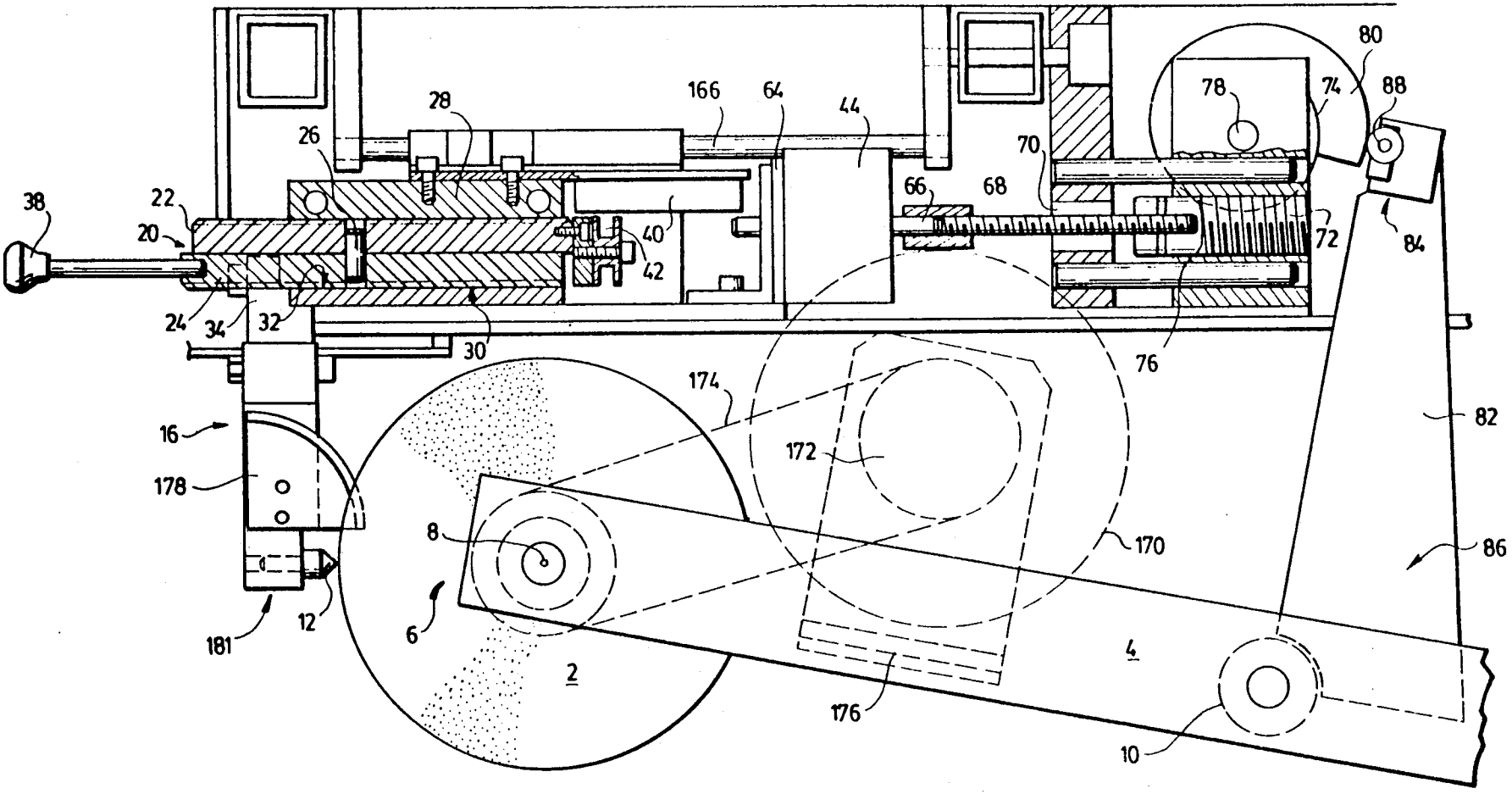
FIG. 6 is a partial side view of a portion of a system for sharpening a grindstone according to the present invention.
Figure 7:
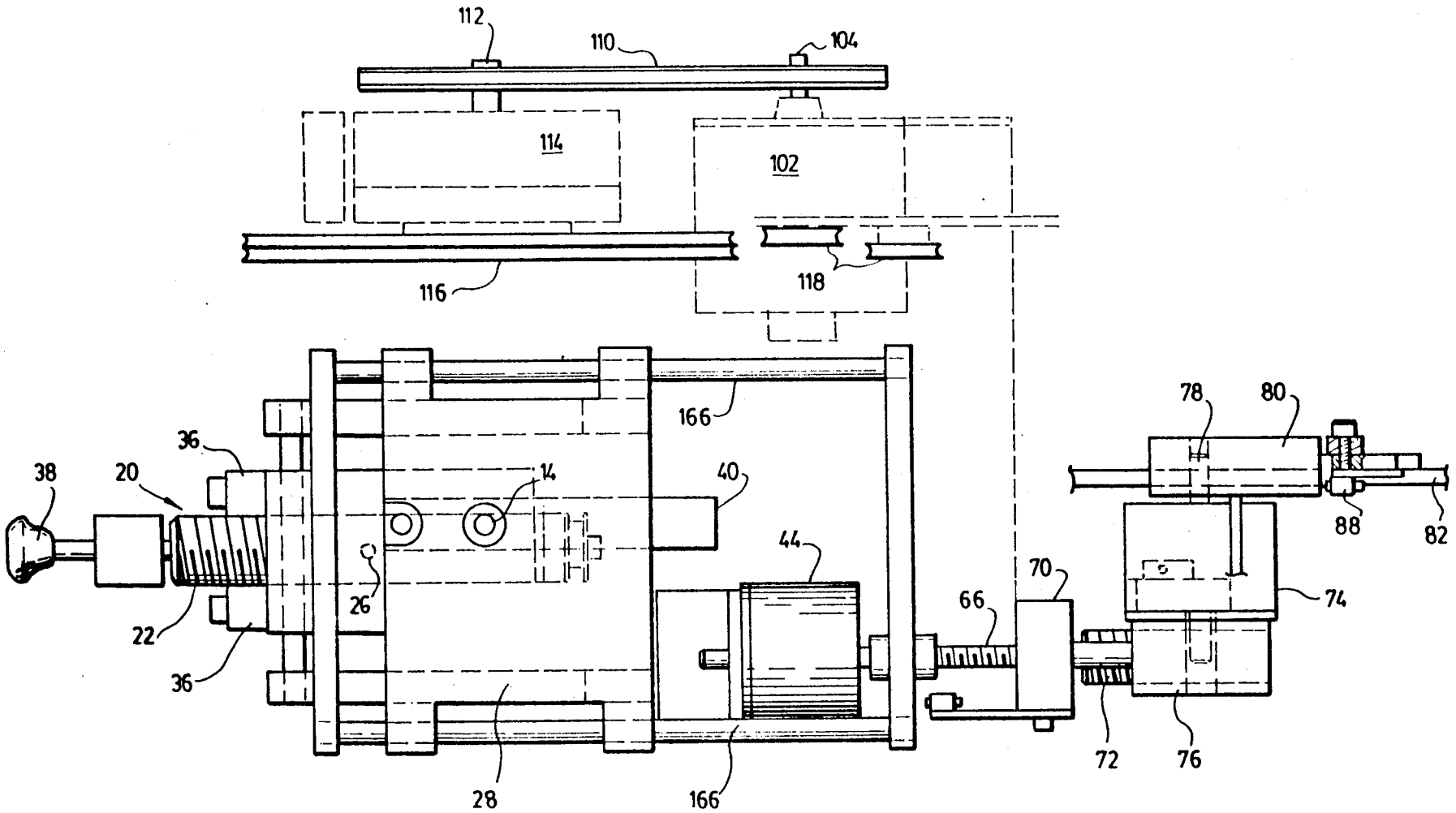
FIG. 7 is a partial view from above of the systems shown in FIGS. 1 and 6.

Referring now more specifically to FIG. 6, a motor 170 has a shaft solid with a pulley 172 connected to the axle 8 supporting the grindstone 2 by means of a strap 174 for rotating the grindstone 2. This motor 170 is mechanically attached to the arm 4 by means of a bracket 176. The arm 16 is provided with a receptacle 178 attached thereto for receiving the particles emitted by the grindstone 2 when it is sharpened. The present apparatus is totally enclosed, and incorporates a vacuum (not shown) having its input connected to the receptacle 178.

Figure 13:
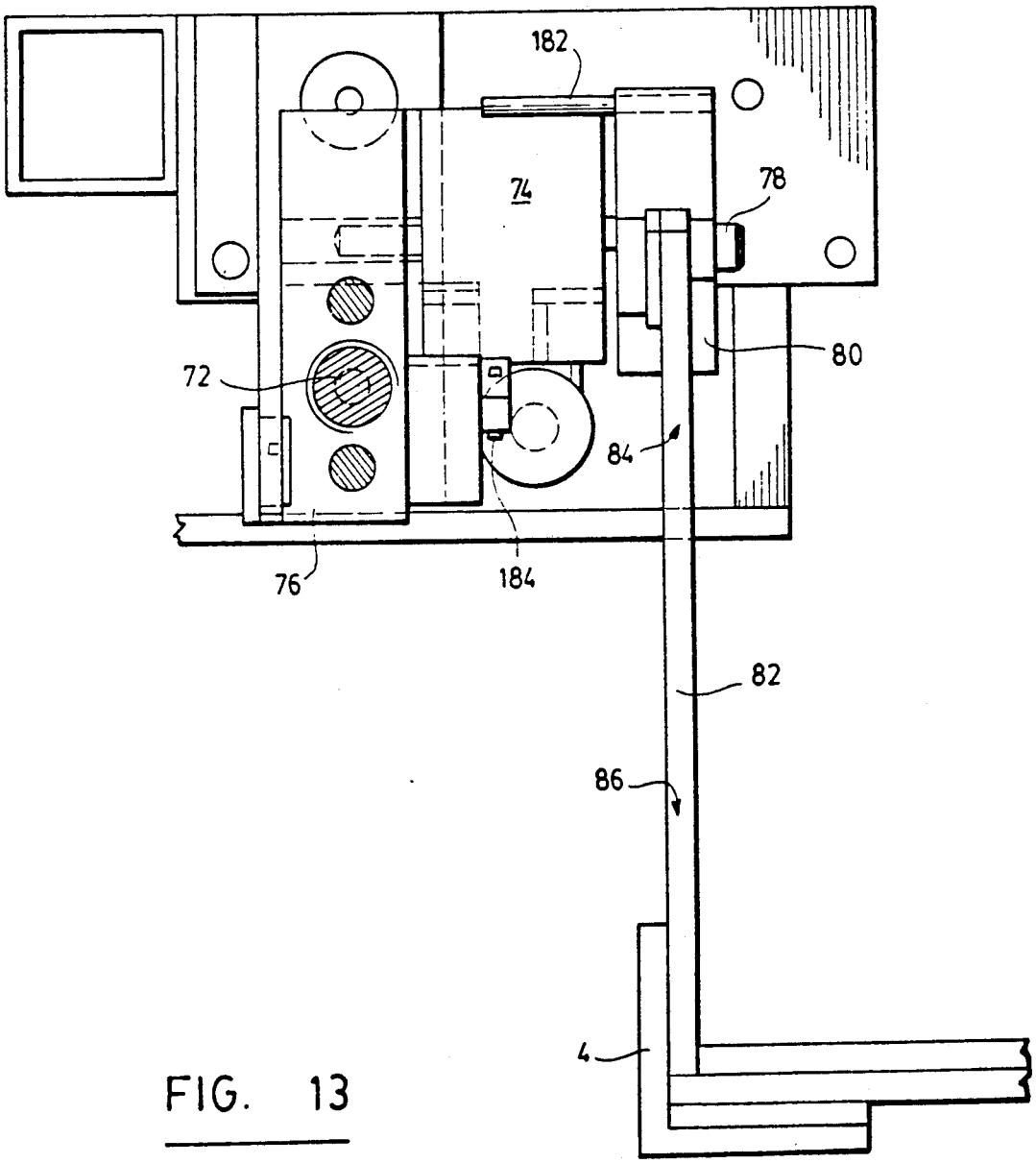
FIG. 13 is a partial back view of a portion of the system shown in FIGS. 6 and 7.

Referring now more specifically to FIG. 13, the cam 248 a pin 182 attached thereto. This pin 182 rotates with the cam 248. A mechanical switch detector 184 is attached to the frame of the motor 244 so that when a reset of the apparatus is done, the motor 244 rotates the cam 248 and when the pin 182 contacts the mechanical switch 184, the apparatus knows what is the position of the cam 248 so that an appropriate activation of the cam 248 can be done. In this FIG. 13, it can be seen that two rods 77 guide the frame 76 when it works.

Figure 8:
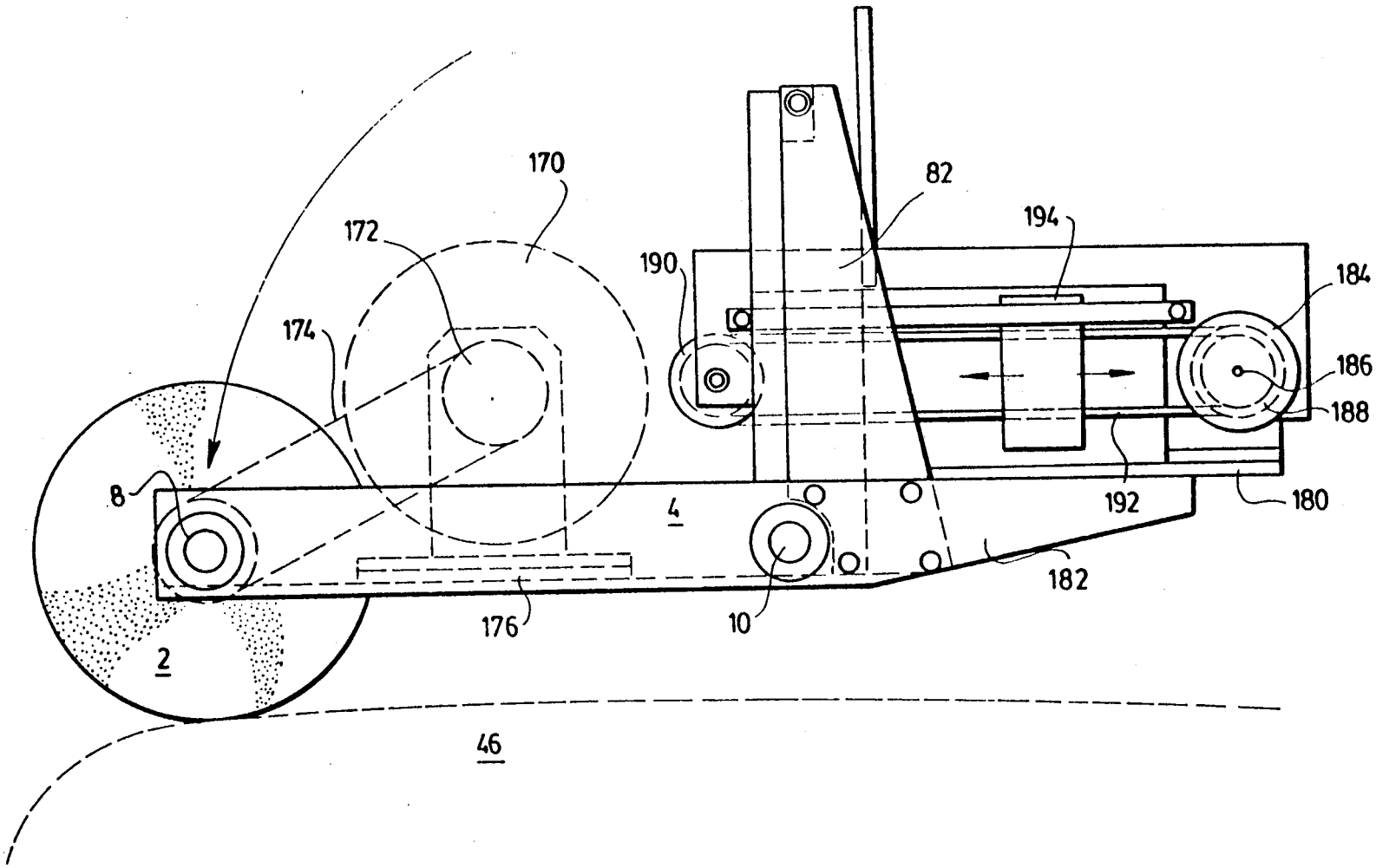
FIG. 8 is a partial side view of another portion of the system for sharpening the blade of a skate according to the present invention.

Referring now to FIG. 8, there is shown a counterweight system attached to the arm 4 to produce a counterweight action with respect to the grindstone 2. This counterweight system comprises a frame 180 attached to the second opposed extremity 258 of the arm 4. It also comprises a motor 260 provided with a shaft 186 connected to a pulley 188. This pulley 188 is solid with another pulley 190 by means of a strap 192, a sliding weight 194 is solid with the strap 192, and supported by a support 195 along which it can slide. The pressure of the grindstone 2 against the blade 46 can be controlled by positioning the weight 194 along the support 195 by means of the motor 260.

Figure 9:
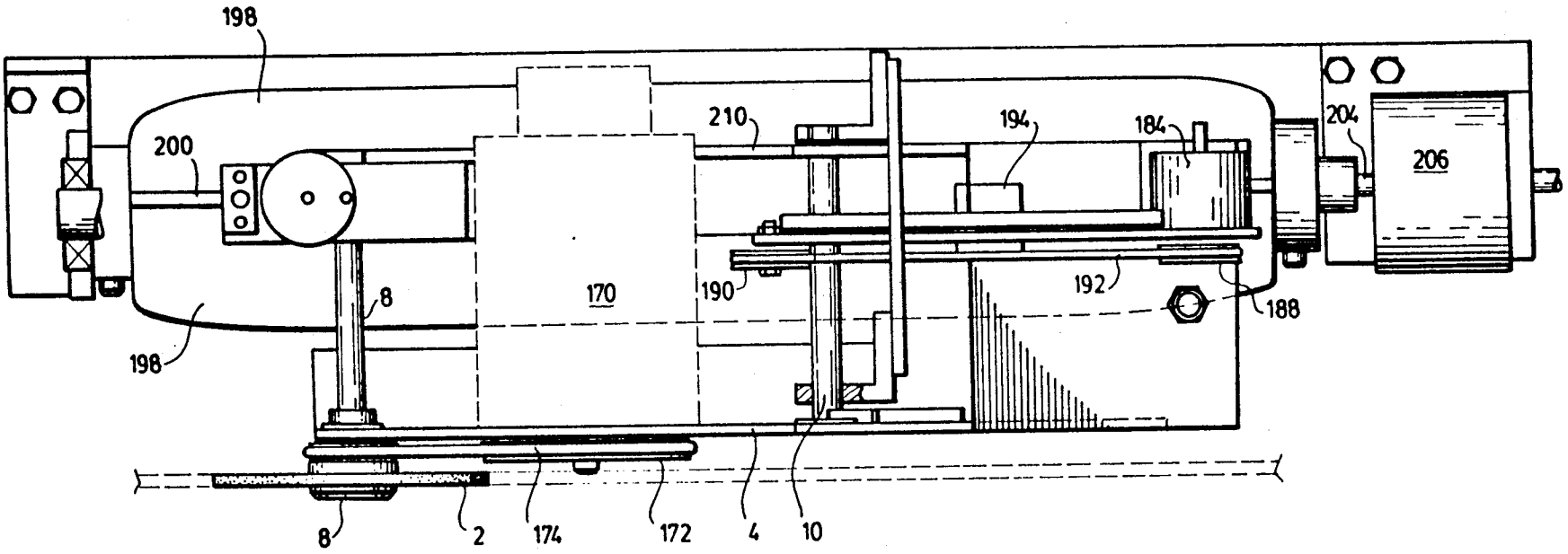
FIG. 9 is a view from above of a system for guiding the grindstone shown in FIG. 8.
Figure 10:
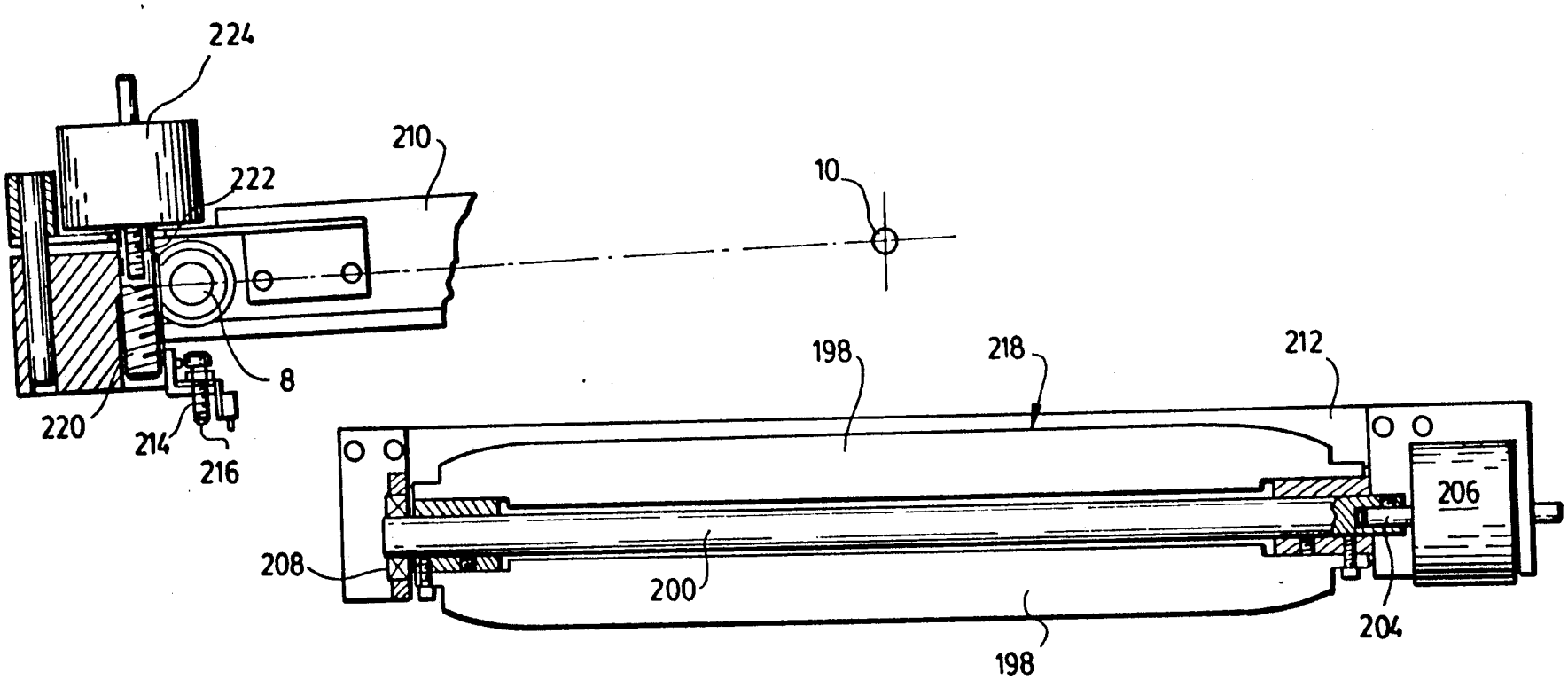
FIG. 10 is a partial side view of the system shown in FIG. 9.
Figure 11:
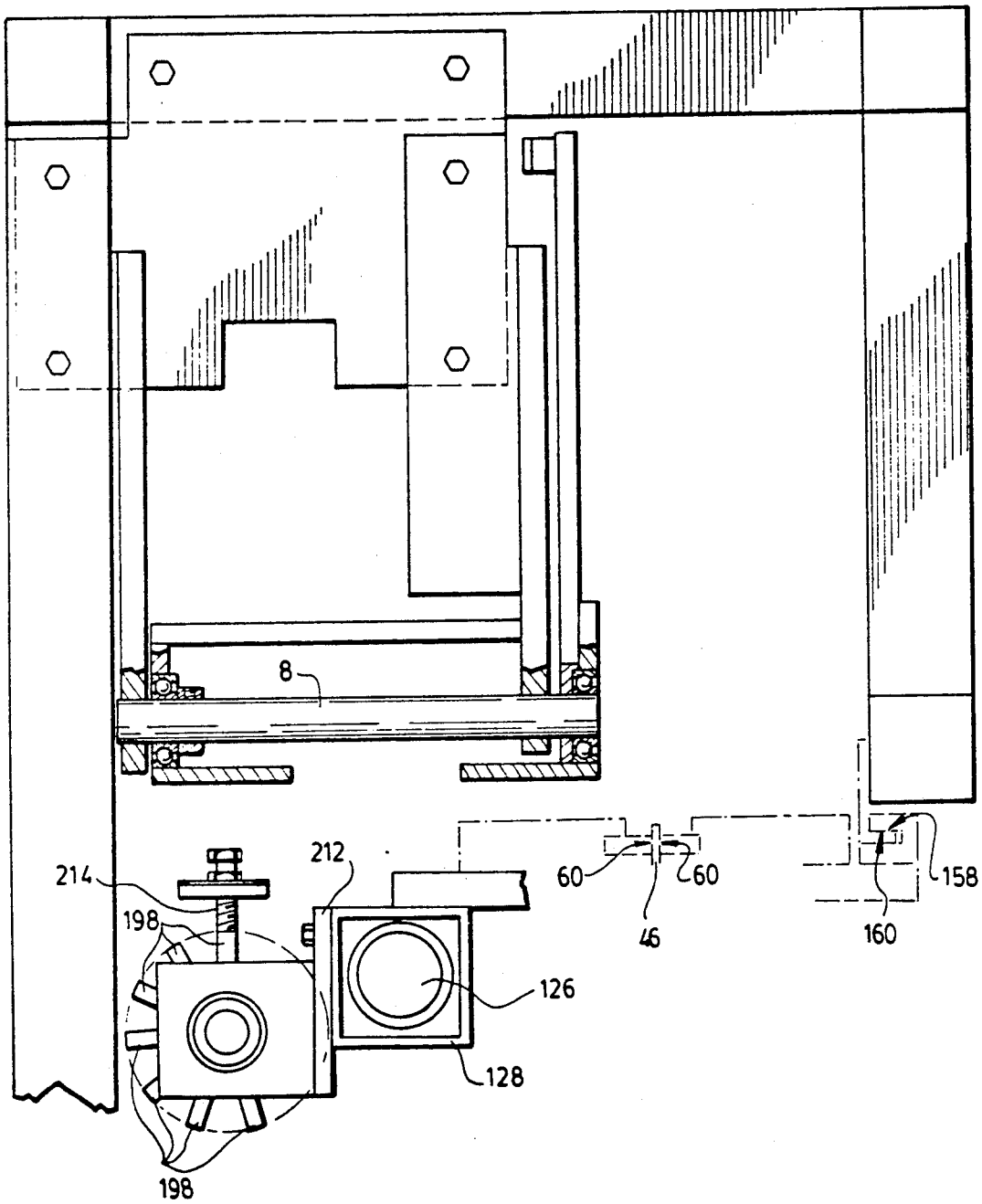
FIG. 11 is a partial back view of the system shown in FIG. 9.

Referring now to FIG. 9, 10 and 11, there is shown a system for guiding the trajectory of the grindstone 2 as it is applied against the blade 46. This guiding system comprises several templates 198 which are rigidly attached along a longitudinal axle 200. This longitudinal axle 200 can be rotated by means of the shaft 204 of a motor 206, whereby a selection of a particular template 198 can be done by rotating the longitudinal axle 200 by means of the motor 206.

The extremity of the longitudinal axle 200 opposed to the motor 206 is supported by a bearing 208 which is attached to the frame of the apparatus. This guiding system also comprises an elongated body 210 that is supported by the axle 10 around which it can pivot. This axle 10 also supports the arm 4. This elongated body 210 has an extremity solid with the axle 8 which supports the grindstone 2 so that every pivoting movement of the elongated body 210 with respect to the axle 10 is transmitted to the grindstone 2 by means of the axle 8. It should be also noted that the frame 212 that supports the templates 198 is solid with the carriage assembly 50 (as shown on FIG. 11) so that during the sharpening of the blade 46, the frame 212 is moved with the carriage assembly 50.

The guiding system also comprises a contact member 214 provided with a contact surface 216 which is positioned so that it contacts the upper surface 218 of the upper template 198 which constitutes the selected template, when the frame 212 is displaced with the carriage assembly 50.

The contact member 214 is rigidly attached to a threaded sleeve 220 which is engaged around a threaded shaft 222 of a motor 224, whereby the vertical position of the contact member 214 can be adjusted by activating the motor 224.

Figure 3:
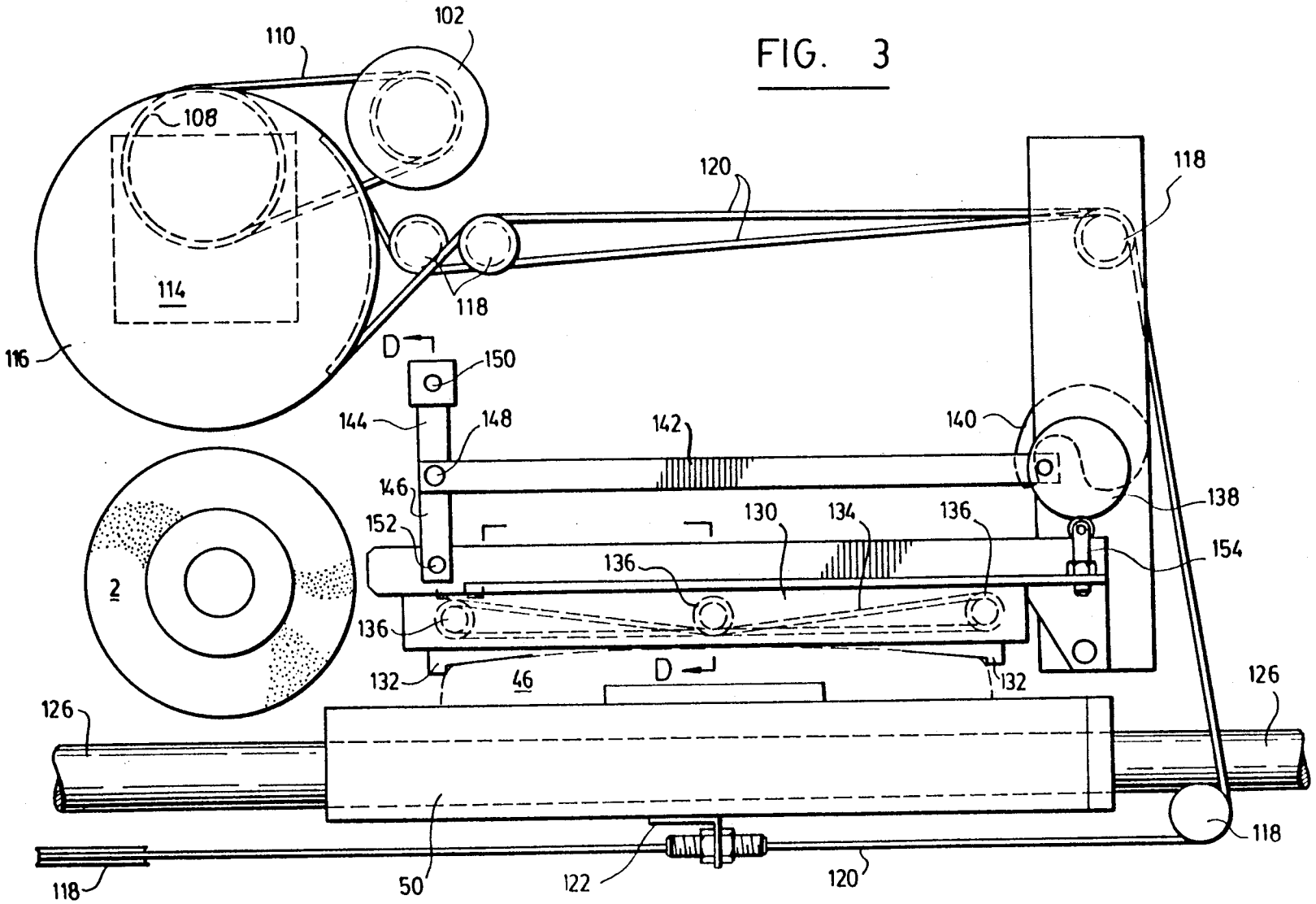
FIG. 3 is a partial side view of the system for conveying the blade of a skate.
Figure 4:
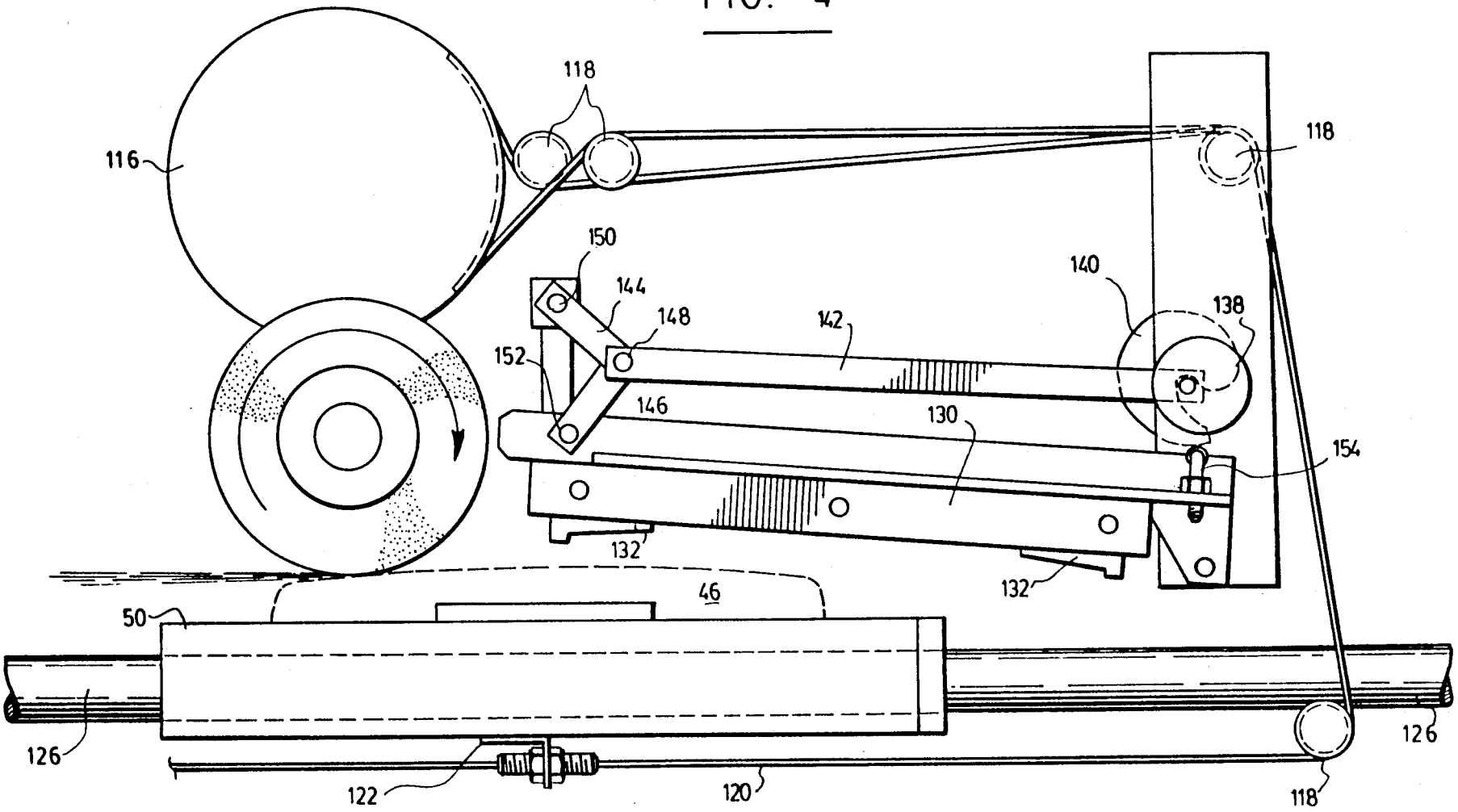
FIG. 4 is a partial side view of the system shown in FIG. 3 is a different position.
Figure 5:
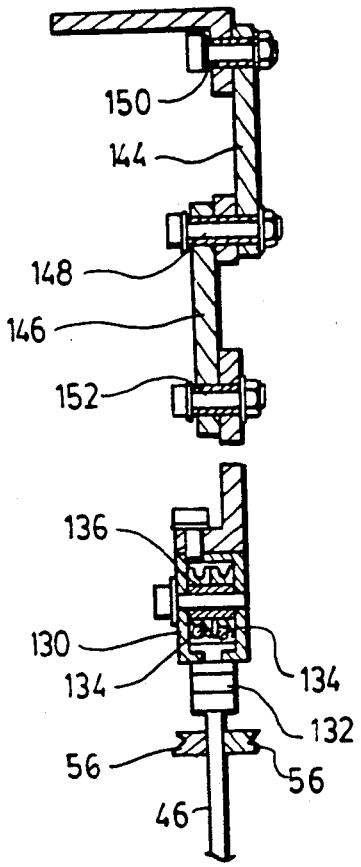
FIG. 5 is a partial back view of a portion of the system shown in FIG. 3.
Figure 12:
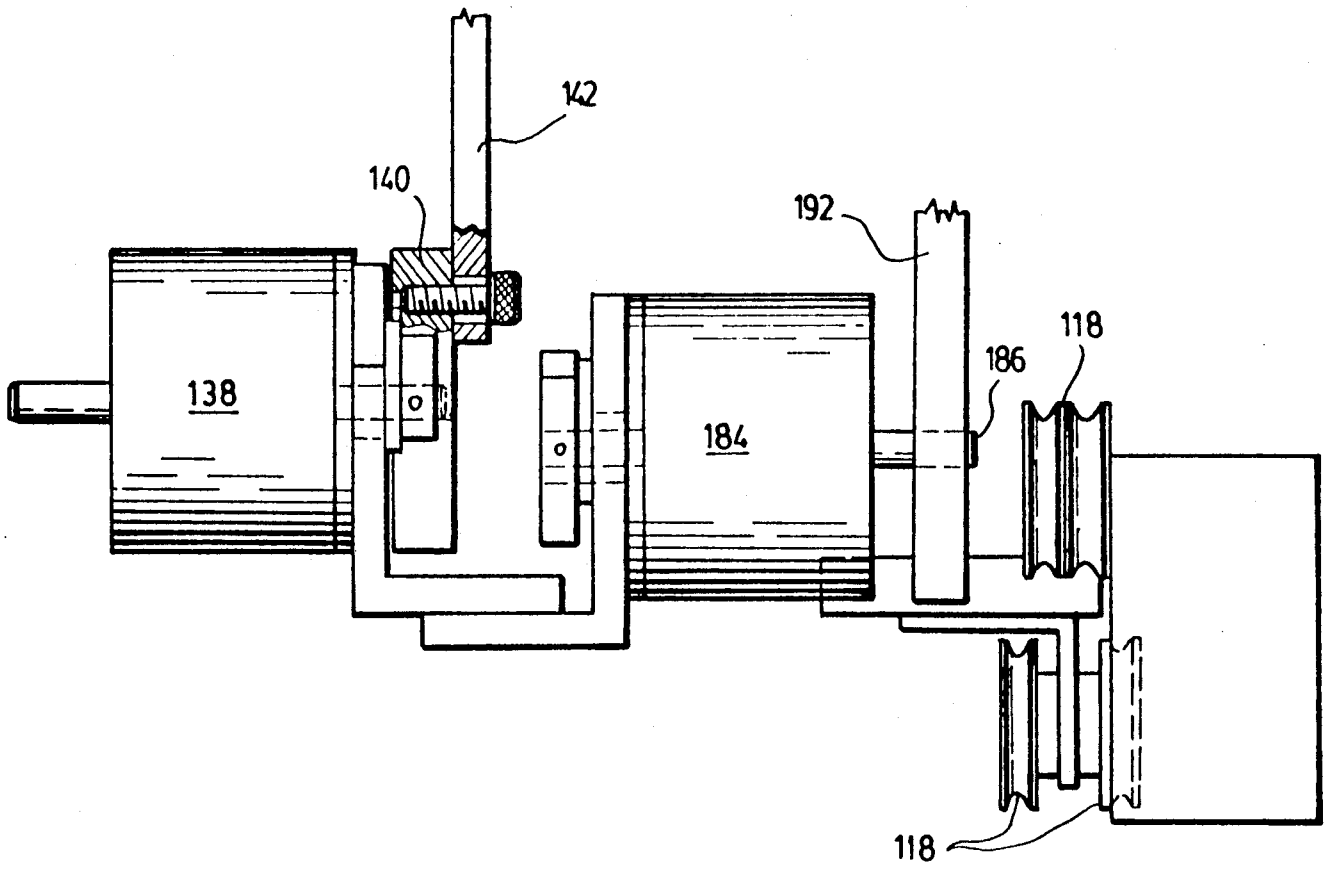
FIG. 12 is a partial view from above of a back portion of the system shown in FIGS. 3 and 4.

Referring now to FIG. 12, there is shown in a view from above of a back portion of the apparatus shown in FIGS. 3 and 4, this view shows how the motor 138 is disposed with respect to the motor 262 that is used to pivot the grindstone from its rest position to its working position and vice versa.

The motor 262 has a shaft 266 connected to a cam 264 having its contact surface adjacent to the contact member 154. This contact member 154 is solid with a frame 180 that is solid with the second opposed extremity 258 of the arm 4. In operation, when the motor 262 is activated, the cam 264 applies a pressure on the contact member 154 and the grindstone 2 is pivoted.

Figure 21:
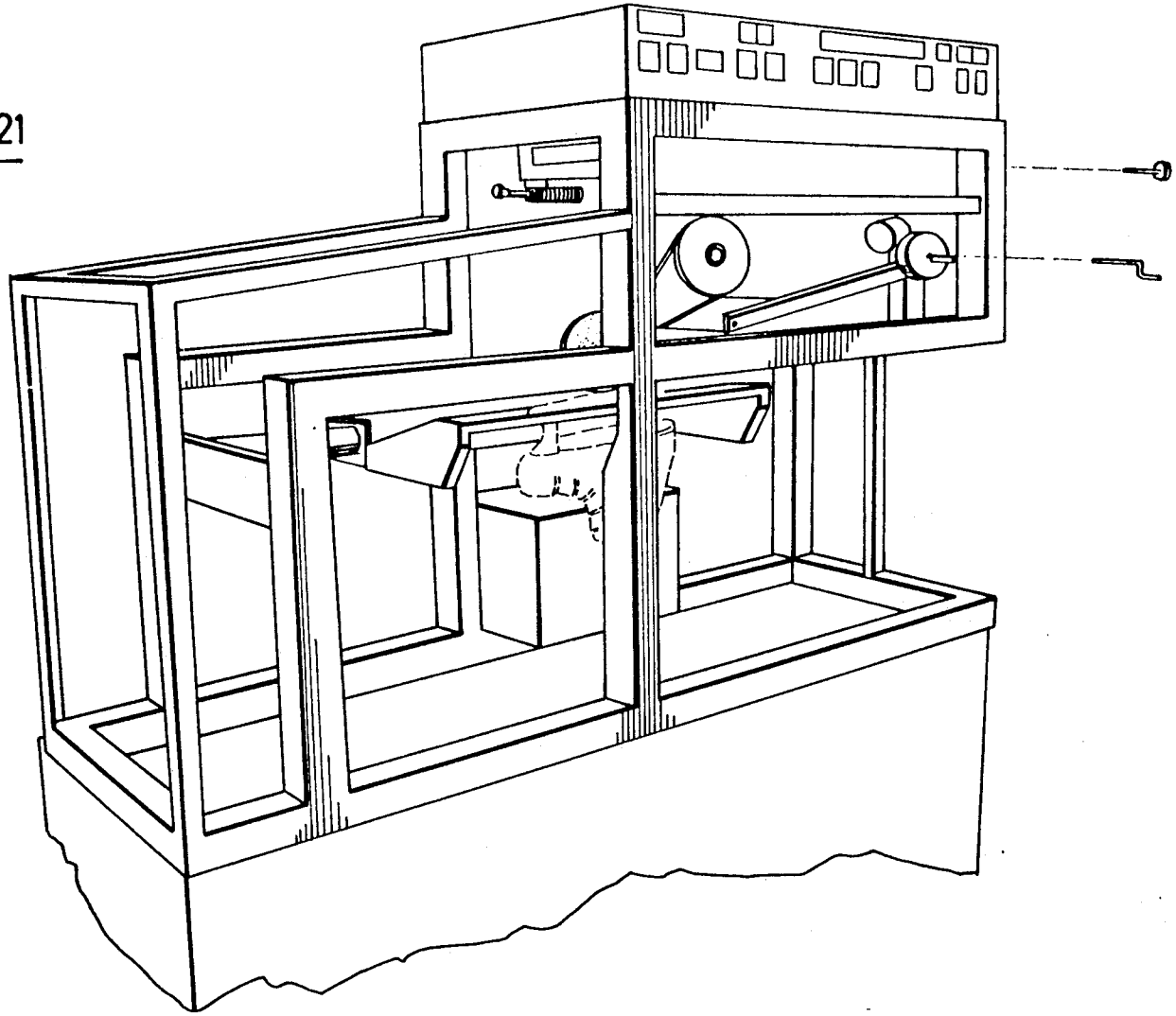
FIG. 21 is a perspective of an apparatus according to the present invention.

Referring now to FIG. 21, there is shown a perspective view of the present apparatus. It should be noted also that the activation of every motor of this apparatus is controlled by a microprocessor according to predetermined sequences. These sequences are selected according to the controlled button appearing on the front panel 230 of the apparatus. It should be also noted that the shaft of every motor of the present apparatus can be rotated by means of handles 232 to allow manual setting of the apparatus by the operator.

The present apparatus comprises a frame 236 made of light weight aluminium which forms a casing that incorporates all the mechanisms of the apparatus. The casing also incorporates a vacuum system (not shown) for collecting the particles produced when the grindstone is sharpened.

The frame of the apparatus is totally enclosed by plastic material so that the dust is kept within the apparatus. The frame is mounted on four wheels (not shown) so that it can be displaced as required.

The operator has an access to the carriage assembly 50 to install a skate by means of a lateral aperture 234.

The front panel 230 comprises several buttons. A first of these buttons is an on/off switch. When this button is pressed, the vacuum system is activated, a light located inside the apparatus is opened, the electric motor 170 of the grindstone is activated, and the electronic display 202 showing the radius of curvature is energized.

The present apparatus is also provided with a variable speed button for varying the speed of the carriage assembly. It is known that different skates manufacturers use steel having different hardness which requires different speeds of the carriage assembly.

To select a radius of curvature, the operator rotates the handle 38, as he is observing the display 202, till he obtains the appropriate radius of curvature. The present apparatus provides a choice for the radius of curvature of 0.250 to 1.750 by increment of 0.031. It can be noted that although the operator may select a radius from 0.250 to 1.750, the diamond does not move during this operation.

The present assembly is provided with a means for adjusting the diamond 12 with respect to the longitudinal axis of the carriage assembly. This adjusting means can move the diamond laterally with respect to the grindstone 2. This adjusting means can also be used for sharpening the grindstone in a flat manner by simply moving the diamond 12 laterally. A grindstone with a flat peripheral surface can now be used for sharpening goalkeeper skate The operator introduces the skate in the carriage assembly 50 with its blade up. The operator introduces the blade between the gripping surfaces 60 until the plastic support of the blade rests against the frame of the carriage assembly 50. Then the operator rotates the handle 78 to secure tightly the blade between the gripping surfaces 60.

Then, the operator presses the button of the start switch, and the carriage assembly is moved forward against the grindstone 2. The carriage assembly moves forwards until it reaches the end of its forward motion. Then, the grindstone is lifted to its rest position and the carriage assembly 50 is brought back to its starting position. When the skate is brought back to its starting position, the operator can rotate the handle 78 and release the skate.

To choose the desired profile for hockey skates, the microprocessor activates the motor 206 to select the appropriate template.

The microprocessor also controls the motor 260 for positioning the counterweight so that the grindstone 2 is applied against the upper surface of the blade 46 according to an appropriate pressure, and the motor 224 for positioning the contact member 214.

The frame 212 is moved with the carriage assembly 50 as they are solid with each other. The grindstone 2 will follow a trajectory against the blade according to the trajectory of the contact surface 216 against the upper surface of the upper template which constitutes the selected template.

When a figure skate has to be sharpened, the operator presses the appropriate button on the front panel 230 so that the microprocessor activates the motor 138 to position the sliding members 132 in their lower position.

These sliding members 132 are needed for centering the blade of the figure skate at a proper position on the carriage assembly 50. The operator positions manually the sliding members 132 over the upper surface of the blade 46 as shown in FIG. 3. When the positioning of the figure skate is done, the operator can rotate the handle 78 to squeeze the blade 46 between the gripping surfaces 60. Then, the operator activates the appropriate button on the front panel 230 for sharpening a figure skate, first the microprocessor will activate the motor 138 to remove the sliding members 132 from the way as shown in FIG. 4. Also, the microprocessor will detect the position of the sliding members 132 to activate the motor 262 so that the grindstone 2 passes above the asperity of the front portion of the figure skate, and so that the sharpening of the back portion is square and sharp.

Of course, a sharpening of the blade can also be done when the carriage assembly is brought back to its starting position. Sharpening of long blade skates or racing skates is done in a similar manner as it is for the hockey skate.

Although the present invention has been explained hereinabove by way of a preferred embodiment thereof, it should be pointed out that any modifications to this preferred embodiment, within the scope of the appended claims is not deemed to change or alter the nature and scope of the present invention.

The embodiments of the invention in which an exclusive property or privilege is claimed are defined as follows:

1. An apparatus for sharpening a blade of a skate, comprising:

a frame;

a circular grindstone having a working position in which said grindstone can contact said blade, and a rest position in which said grindstone can be sharpened;

an arm for supporting said grindstone, said arm having a first extremity provided with an axle for supporting said grindstone, and a second opposed extremity, said arm being capable of pivoting around an axle firmly attached to said frame so that said grindstone can be pivoted from said working position to said rest position and vice versa;

a diamond assembly including:

a diamond for sharpening said grindstone when said grindstone is in said rest position by pivoting said diamond horizontally from a central position to alternatively left or right with respect to a pivoting axis so that said diamond defines a circular motion which has a radius of curvature determined by a distance between said diamond and said pivoting axis; and a member having a first extremity onto which said diamond is fixed, and a second extremity provided with a surface facing the ground;

a body for supporting said diamond assembly by said second extremity of said member, including:

a screw separated along its length to form first and second complementary elongated parts;

a pivoting pin transverse to a longitudinal axis of said screw, said pivoting pin connecting said first part to said second part so that said second part can be pivoted with respect to said first part, around said pivoting pin, said body comprising upper and lower members forming a cavity provided with threads contacting upper and lower portions of said screw so that said screw can be screwed along said cavity by rotation thereof, said body including a bearing surface for vertically supporting said surface of said second extremity of said member, when said second part of said screw is in a lower position, said second part can be pivoted with said lower member of said body, horizontally from a central position to alternatively left or right around said pivoting pin;

supporting means for supporting said body with respect to said frame of said apparatus; and connecting means for rendering said second extremity of said member of said diamond assembly solid with an extremity of said second complementary elongated part only when said second part is pivoted horizontally away from its central position so that said pivoting pin forms said pivoting axis of said diamond, whereby said radius of curvature can be modified by displacing said screw along said cavity.

2. Apparatus according to claim 1, wherein said connecting means comprise a portion solid with said second extremity of said member of said diamond assembly, and an upper extremity forming a fork having two prongs surrounding said second complementary elongated part of said screw when said second part is in its lower position, said prongs having upper extremities which are lower than the lowest portion of said first part of said screw when said second part is in its lower position so that said upper extremities of said prongs do not interfere with said first part when said second part is pivoted alternatively to left or right.

3. Apparatus according to claim 1, further comprising a handle attached to said second part of said screw, by which an operator can rotate said screw or pivot said second part alternatively to left or right.

4. Apparatus according to claim 1, further comprising a potentiometer having a sensing element connected to said first part of said screw so that a signal indicative of said radius of curvature can be generated by said potentiometer.

5. An apparatus according to claim 1, 2, 3 or 4, further comprising:

for motor means for moving said body with respect to said frame so that when a sharpening of said grindstone is needed, said body is moved with respect to said frame to bring said diamond closer to said grindstone by a predetermined distance; and linking means for rendering said body solid with said second opposed extremity of said arm so that when said diamond is brought closer to said grindstone, said arm for supporting said grindstone is pivoted according to a predetermined angle by means of said linking means, whereby a wear of said grindstone is compensated by a feedback action provided by said linking means so that said diamond always contacts said grindstone at a preferred level during a sharpening of said grindstone.

6. An apparatus according to claim 5, further comprising conveying means for holding said blade, and for conveying an upper edge of said blade against said grindstone when said grindstone is in said working position, said conveying means comprising:

a carriage assembly having:

a frame provided with a longitudinal axis;

two fixed portions solid with said frame of said carriage assembly and disposed on both sides of said longitudinal axis of said carriage assembly, said fixed portions being provided respectively with oblique surfaces facing each other and converging in a same direction;

two mobile portions disposed on both sides of said longitudinal axis of said carriage assembly, said mobile portions being provided respectively with oblique surfaces facing and contacting said oblique surfaces of the respective fixed portions, and with gripping surfaces facing each other with respect to said longitudinal axis of said carriage assembly;

resilient means for biasing said oblique surfaces of said mobile portions against the respective oblique surfaces of said fixed portions; and moving means for moving said mobile portions in a direction parallel to said longitudinal axis of said carriage assembly, against said fixed portions so that said blade can be held by said gripping surfaces, whereby said upper edge of said blade has its central longitudinal axis forming with said longitudinal axis of said carriage assembly always a same predetermined plane independently of a thickness of said blade.

7. An apparatus for sharpening a blade of a skate, comprising:

a frame;

a circular grindstone having a working position in which said grindstone can contact said blade, and a rest position in which said grindstone can be sharpened;

an arm for supporting said grindstone, said arm having a first extremity provided with an axle for supporting said grindstone, and a second opposed extremity, said arm being capable of pivoting around an axle firmly attached to said frame so that said grindstone can be pivoted from said working position to said rest position and vice versa;

a diamond assembly including:

a diamond for sharpening said grindstone when said grindstone is in said rest position by pivoting said diamond horizontally from a central position alternatively to left or right with respect to a pivoting axis so that said diamond defines a circular motion which has a radius of curvature determined by a distance between said diamond and said pivoting axis; and a member having a first extremity onto which said diamond is fixed, and a second extremity;

a body for supporting said diamond assembly by said second extremity of said member, including:

an elongated element; and a pivoting pin transverse to a longitudinal axis .of said elongated element so that said elongated element can be pivoted around said pivoting pin;

supporting means for supporting said body with respect to said frame;

connecting means for rendering said second extremity of said member solid with an extremity of said elongated element so that said pivoting pin forms said pivoting axis of said diamond;

first motor means for moving said body with respect to said frame so that when a sharpening of said grindstone is needed, said body is moved with respect to said frame to bring said diamond closer to said grindstone by a predetermined distance; and linking means for rendering said body solid with said second opposed extremity of said arm so that when said diamond is brought closer to said grindstone, said arm for supporting said grindstone is pivoted according to a predetermined angle by means of said linking means, whereby a wear of said grindstone is compensated by a feedback action provided by said linking means so that said diamond always contacts said grindstone at a preferred level during a sharpening of said grindstone.

8. Apparatus according to claim 7, wherein:

said first motor means comprise a frame rigidly fixed to said body, and a shaft having a first threaded portion engaged in a cylindrical threaded cavity of a body rigidly fixed to said frame of said apparatus so that a rotation of said shaft moves said body with respect to said frame of said apparatus, said shaft having a second threaded portion; and said linking means comprise:

a second motor means having a frame provided with a cylindrical threaded cavity in which said second threaded portion can be engaged, and a shaft;

a cam engaged around said shaft of said second motor means whereby the height of said grindstone when said grindstone is in its working position can be adjusted by a rotation of said cam of said second motor means; and an elongated arm having a first extremity having a contact surface capable of contacting said cam, and a second extremity solid with said second opposed extremity of said arm for supporting said grindstone, whereby said feedback action is provided by a rotation of said second threaded portion which moves said frame of said second motor means, which displaces said cam which displaces said elongated arm of said linking means to pivot said arm for supporting said grindstone according to said predetermined angle.

9. An apparatus according to claim 7, wherein said predetermined distance is substantially 0.05mm.

10. An apparatus according to claim 7, wherein said contact surface is provided with a contact switch which produces a signal that indicates whether or not said contact switch contacts said cam whereby said signal of said contact switch indicates whether or not said blade is actually being sharpened.

11. An apparatus according to claim 7, 8, 9 or 10, wherein:

said elongated element comprises a screw separated along its length to form first and second complementary elongated parts;

said pivoting pin is transverse to a longitudinal axis of said screw, and connects said first part to said second part so that said second part can be pivoted with respect to said first part, around said pin;

said second extremity of said member is provided with a surface facing the ground;

said body comprises upper and lower members forming a cavity provided with threads contacting upper and lower portions of said screw so that said screw can be screwed along said cavity by rotation thereof, said body including a bearing surface for vertically supporting said surface of said second extremity of said member, when said second part of said screw is in a lower position, said second part can be pivoted with said lower member of said body, horizontally from a central position to alternatively left or right around said pivoting pin; and said apparatus further comprises connecting means for rendering said second extremity of said member of said diamond assembly solid with an extremity of said second complementary elongated part only when said second complementary elongated part is pivoted horizontally away from its central position so that said pivoting pin forms said pivoting axis of said diamond, whereby said radius of curvature can be modified by displacing said screw along said cavity.

12. An apparatus according to claim 11, further comprising conveying means for holding said blade, and for conveying an upper edge of said blade against said grindstone when said grindstone is in said working position, said conveying means comprising:

a carriage assembly having:

a frame provided with a longitudinal axis;

two fixed portions solid with said frame of said carriage assembly and disposed on both sides of said longitudinal axis, said fixed portions being provided respectively with .oblique surfaces facing each other and converging in a same direction;

two mobile portions disposed on both sides of said longitudinal axis of said carriage assembly, said mobile portions being provided respectively with oblique surfaces facing and contacting said oblique surfaces of the respective fixed portions, and with gripping surfaces facing each other with respect to said longitudinal axis of said carriage assembly;

resilient means for biasing said oblique surfaces of said mobile portions against the respective oblique surfaces of said fixed portions; and moving means for moving said mobile portions in a direction parallel to said longitudinal axis of said carriage assembly, against said fixed portions so that said blade can be held by said gripping surfaces, whereby said upper edge of said blade has its central longitudinal axis forming with said longitudinal axis of said carriage assembly always a same predetermined plane independently of a thickness of said blade.

13. An apparatus for sharpening a blade of a skate, comprising:

a frame;

a circular grindstone having a working position in which said grindstone can contact said blade, and a rest position in which said grindstone can be sharpened;

an arm for supporting said grindstone, having a first extremity provided with an axle for supporting said grindstone, and capable of pivoting around an axle firmly attached to said frame so that said grindstone can be pivoted from said working position to said rest position;

a diamond assembly including:

a diamond for sharpening said grindstone when said grindstone is in said rest position by pivoting said diamond horizontally from a central position alternatively to left or right with respect to a pivoting axis so that said diamond defines a circular motion which has a radius of curvature determined by a distance between said diamond and said pivoting axis; and a member having a first extremity onto which said diamond is fixed, and a second extremity provided with a surface facing the ground;

a body for supporting said diamond assembly by said second extremity of said member;

supporting means for supporting said body with respect to said frame;

conveying means for holding said blade, and for conveying an upper edge of said blade against said grindstone when said grindstone is in said working position, said conveying means comprising:

a carriage assembly having:

a frame provided with a longitudinal axis;

two fixed portions solid with said frame of said carriage assembly and disposed on both sides of said longitudinal axis, said fixed portions being provided respectively with oblique surfaces facing each other and converging in a same direction;

two mobile portions disposed on both sides of said longitudinal axis of said carriage assembly, said mobile portions being provided respectively with oblique surfaces facing and contacting said oblique surfaces of the respective fixed portions, and with gripping surfaces facing each other with respect to said longitudinal axis of said carriage assembly; and resilient means for biasing said oblique surfaces of said mobile portions against the respective oblique surfaces of said fixed portions; and moving means for moving said mobile portions in a direction parallel to said longitudinal axis of said carriage assembly, against said fixed portions so that said blade can be held by said gripping surfaces, whereby said upper edge of said blade has its central longitudinal axis forming with said longitudinal axis of said carriage assembly always a same predetermined plane independently of a thickness of said blade.

14. An apparatus according to claim 13, wherein said moving means comprise:

threaded element having an elongated body provided with a threaded portion along its length, said threaded element having a first extremity adjacent to said frame of said carriage assembly, and a second extremity provided with a handle;

a horizontal member provided with a threaded cavity in which said threaded portion of said threaded element is engaged, said horizontal member having two extremities;

a pair of vertical members having respectively first and second extremities, said first extremities of said pair of vertical members being respectively connected by means of horizontal pivoting axes to said two extremities of said horizontal member;

a pair of horizontal members having respectively first and second extremities, said first extremities of said pair of horizontal members being respectively connected by means of vertical and horizontal pivoting axes to said second extremities of said pair of vertical members, said second extremities of said pair of horizontal members being respectively connected to said mobile portions by means of vertical pivoting axes, whereby said mobile portions can be moved in a direction parallel to said longitudinal axis of said carriage assembly against said fixed portions by a rotation of said handle of said threaded element.

15. An apparatus according to claim 13, wherein said resilient means comprise a first pair of springs respectively connected between said frame of said carriage assembly and said second extremities of said pair of horizontal members for biasing said oblique surfaces of said mobile portions against the respective oblique surfaces of said fixed portions; and a second pair of springs respectively connected between said fixed and mobile portions.

16. An apparatus according to claim 13, further comprising a vertical pivoting axis connecting said frame of said carriage assembly and one of said fixed portions so that said gripping surfaces of its adjacent mobile portion can pivot, whereby an adjustment of said gripping surfaces with respect to said blade can be provided when said blade is curved along its length.

17. An apparatus according to claim 13, 14, 15 or 16 wherein said body includes:

a screw separated along its length to form first and second complementary elongated parts;

a pivoting pin transverse to a longitudinal axis of said screw, said pivoting pin connecting said first part to said second part so that said second part can be pivoted with respect to said first part, around said pivoting pin, said body comprising upper and lower members forming a cavity provided with threads contacting upper and lower portions of said screw so that said screw can be screwed along said cavity by rotation thereof, said body including a supporting surface for vertically supporting said surface of said second extremity of said member, when said second part of said screw is in a lower position, said second part can be pivoted with said lower member of said body, horizontally from a central position to alternatively left or right around said pivoting pin; and connecting means for rendering said second extremity of said member of said diamond assembly solid with an extremity of said second complementary elongated part only when said second complementary elongated part is pivoted horizontally away from its central position so that said pivoting pin forms said pivoting axis of said diamond, whereby said radius of curvature can be modified by displacing said screw along said cavity.

18. An apparatus according to claim 17, further comprising:

first motor means for moving said body with respect to said frame so that when a sharpening of said grindstone is needed, said body is moved with respect to said frame to bring said diamond closer to said grindstone by a predetermined distance; and linking means for rendering said body solid with said second opposed extremity of said arm so that when said diamond is brought closer to said grindstone, said arm for supporting said grindstone is pivoted according to a predetermined angle by means of said linking means, whereby a wear of said grindstone is compensated by a feedback action provided by said linking means so that said diamond always contacts said grindstone at a preferred level during a sharpening of said grindstone.

* * * * *